US005402931A

United States Patent [19]

Gulliver et al.

[11] Patent Number: 5,402,931

[45] Date of Patent: Apr. 4, 1995

[54] CARTON WITH LID SEALED TO TRAY END FLANGES AND LID FLAPS SEALED TO TRAY SIDES

[75] Inventors: Richard F. Gulliver; James R. Green, both of Tuscaloosa, Ala.

[73] Assignee: Gulf States Paper Corporation, Tuscaloosa, Ala.

[21] Appl. No.: 119,656

[22] Filed: Sep. 13, 1993

Related U.S. Application Data

[63] Continuation-in-part of Ser. No. 90,506, Jul. 12, 1993, which is a continuation-in-part of Ser. No. 975,005, Nov. 12, 1992, Pat. No. 5,265,796, and Ser. No. 964,870, Oct. 22, 1992, Pat. No. 5,267,686, which is a continuation-in-part of Ser. No. 796,599, Nov. 13, 1991, Pat. No. 5,183,201, said Ser. No. 975,005, is a continuation-in-part of Ser. No. 796,599, Nov. 13, 1991.

[51] Int. Cl.[6] ..... B65D 5/48; B65D 5/58

[52] U.S. Cl. ..... 229/186; 229/120.17; 229/125.35; 229/228; 229/242; 229/906

[58] Field of Search ..... 229/120.16, 120.17, 229/120.011, 125.35, 186, 228, 240, 242–244, 902, 903, 906

[56] References Cited

U.S. PATENT DOCUMENTS

| | | |
|---|---|---|
| D. 302,068 | 7/1989 | Forbes, Jr. et al. . |
| 2,215,348 | 9/1940 | Cowan . |
| 2,241,710 | 5/1941 | Lowey . |
| 2,241,711 | 5/1941 | Lowey . |

(List continued on next page.)

FOREIGN PATENT DOCUMENTS

| | | |
|---|---|---|
| 521344 | 7/1953 | Belgium . |
| 1404055 | 11/1965 | France . |
| 396992 | 1/1921 | Germany . |
| 738714 | 8/1943 | Germany . |
| 939550 | 2/1956 | Germany . |
| 1022516 | 6/1958 | Germany . |
| 1142099 | 7/1963 | Germany . |
| 1265648 | 4/1968 | Germany . |
| 8052 | of 1912 | United Kingdom . |
| 944763 | 12/1963 | United Kingdom . |

*Primary Examiner*—Gary E. Elkins
*Attorney, Agent, or Firm*—Cushman, Darby & Cushman

[57] ABSTRACT

A carton package comprising a plurality of blanks of carton material cut and scored so as to provide one or more tray compartments and a separate lid part. The lid part includes a lid panel having a pair of opposed end edges defined by a pair of opposed parallel free marginal edge portions extending along the top of a pair of opposed ends of the package and a pair of opposed side edges defined by a pair of opposed parallel lid flap panel fold lines integral with a pair of lid flap panels folded downwardly along the lid flap panel fold lines in generally perpendicular relation to the lid panel so as to define substantially the entirety of a pair of opposed sides of the package. The lid panel extends over the open top space provided by the one or more tray compartments which present (1) side wall panels disposed along the pair of opposed package ends having integral flanges extending outwardly from the outer edges thereof and constituting end defining side wall panels and (2) side wall panels extending along the pair of opposed package sides constituting side defining side wall panels. The interior surface of the flanges and the interior surfaces of the lid panel free marginal edge portions are sealed together in pressurized abutting relation with heat activated adhesive therebetween. The exterior surfaces of the side defining side wall panels and the interior surfaces of the lid flap panels are sealed together in contact abutting relation with heat activated adhesive therebetween.

19 Claims, 17 Drawing Sheets

U.S. PATENT DOCUMENTS 2,409,460 10/1946 Waters .
2,665,616 1/1954 Jungmayr .
2,781,159 2/1957 Copeman .
2,828,061 3/1958 Zerlin .
2,847,151 8/1958 Meyer-Jagenberg .
3,064,874 11/1962 Kauffeld .
3,146,934 9/1964 Steiger .
3,211,359 10/1965 Fickes .
3,253,765 5/1966 Train .
3,721,380 3/1973 Meyers .
3,829,004 8/1974 Graser .
3,863,832 2/1975 Gordon et al. .
4,130,237 12/1978 Struble .
4,215,780 8/1980 Carlson .
4,304,352 12/1981 Humphries .
4,361,236 11/1982 Lavery .
4,449,633 5/1984 Johnson et al. .
4,594,492 6/1986 Maroszek .
4,742,917 5/1988 Bornwasser et al. .
4,746,019 5/1988 Prater .
4,836,439 6/1989 Hart .
4,848,648 7/1989 Eisman .
4,901,911 2/1990 Drexhage .
4,905,889 3/1990 Schuster .
4,919,269 4/1990 Wright et al. .
4,919,785 4/1990 Willey et al. .
4,930,639 6/1990 Rigby .
4,944,451 7/1990 Forbes, Jr. .
4,951,868 8/1990 Mode .
5,009,320 4/1991 Kramer .
5,009,363 4/1991 Zavatone .
5,012,929 5/1991 Roosa .
5,012,979 5/1991 Williams .
5,038,940 8/1991 Okabe .
5,183,201 2/1993 Gulliver .
5,217,159 6/1993 Calvert et al. .
5,265,796 11/1993 Gulliver et al. .
5,267,686 12/1993 Gulliver et al. .
5,330,099 7/1994 Beales et al. .

CARTON WITH LID SEALED TO TRAY END FLANGES AND LID FLAPS SEALED TO TRAY SIDES

This application constitutes a continuation-in-part of application Ser. No. 08/090,506, pending, filed on Jul. 12, 1993, in the name of Richard F. Gulliver and James R. Green for a PLURAL TRAY COMPARTMENT CARTON PACKAGE which application is, in turn, a continuation-in-part of application Ser. No. 07/975,005, now U.S. Pat. No. 5,265,796 filed on Nov. 12, 1992, in the name of Richard F. Gulliver and James R. Green for a PLURAL COMPARTMENT CARTON FOOD TRAY WITH IMPROVED CORNER CONSTRUCTION and a continuation-in-part of application Ser. No. 07/964,870, now U.S. Pat. No. 5,267,686 filed on Oct. 22, 1992, in the name of Richard F. Gulliver and James R. Green for a FOOD PACKAGE CONTAINING SEPARATE TRAYS CONNECTED TOGETHER BY A SINGLE LID STRUCTURE, both of which are continuations-in-part of application Ser. No. 07/796,599, filed Nov. 13, 1991, in the name of Richard F. Gulliver for CARTON TRAY WITH IMPROVED CORNER CONSTRUCTION AND METHOD OF MAKING which was issued on Feb. 2, 1993, as U.S. Pat. No. 5,183,201.

This invention relates to food packages and, more particularly, to food packages of the type including a carton assembly having one or more compartments suitable to contain one or more food portions therein.

In the '506 application there is disclosed several embodiments of a carton package providing plural compartments suitably closed to contain consumable contents therein for shipping and handling so that the contents can be (1) heated in an oven while retained therein in a vented condition and (2) thereafter consumed while retained therein in an accessed condition. The carton package comprises a plurality of blanks of carton material cut and scored so as to provide a plurality of tray compartments and a separate lid part for the plurality of tray compartments. Each of the tray compartments includes a bottom wall panel having a periphery defined by interconnecting side fold lines interrelated so that each adjacent pair of side fold lines extends at an angle with respect to each other from a corner point defining a corner of the bottom wall panel. The side wall panels extend integrally from the side fold lines and are interrelated so there are a plurality of pairs of adjacent side wall panels. The side wall panels are folded upwardly along the side fold lines and have outer edges defining an open top space for containing a consumable content. Each compartment also includes an integral corner connection between each pair of adjacent side wall panels. Each integral corner connection is folded and sealed so as to form leak-tight sealed integral corners for the open top space.

The lid part includes a planar rectangular lid panel defining the top of the package. The lid panel has a pair of opposed end edges defined by a pair of opposed parallel free marginal edge portions extending along the top of a pair of opposed ends of the package and a pair of opposed side edges defined by a pair of opposed parallel lid flap panel fold lines. The lid part also includes a pair of lid flap panels integral with the pair of opposed side edges and folded downwardly along the lid flap panel fold lines in generally perpendicular relation to the planar lid panel so as to define substantially the entirety of a pair of opposed sides of the package. The planar rectangular lid panel has an area greater than the combined area of the open top spaces of the tray compartments and extends thereover in generally closing relation thereto with the tray compartments disposed in generally side-by-side relation therebelow so as to present a side wall panel of each of two of the plurality of tray compartments disposed along the pair of opposed package ends constituting end defining side wall panels, a number of side wall panels equal to the number of tray compartments extending along each of the pair of opposed package sides constituting side defining side wall panels, and a remainder of the side wall panels of the tray compartments disposed interiorly of the package and extending generally between the pair of opposed package sides and constituting interior side wall panels. The end defining side wall panels extending along the pair of opposed package ends have integral flanges extending outwardly from the outer edges thereof which are sealingly adhered to the free marginal edge portions of the lid panel so as to define the pair of opposed package ends. The side defining side wall panels extending along the pair of opposed package sides are adhered to the lid flap panels to rigidify the connection of the tray compartments and to provide a substantially smooth exterior surface along the package sides. The lid part has cuts therein for facilitating the manual venting and accessing of each tray compartment space.

The system used to sealingly close the carton after the separate lid has been assembled in operative relation with the structure providing the plural tray compartments utilized both heat and rolling pressure in the case of the ends of the package and heat and contact pressure in the case of the sides of the package. The ends of the package are defined by flanged end wall panels whereas the sides are defined by lid flaps overlapping side wall panels. In the case of the package ends the heat activatible adhesive on the interior surfaces of the tray flanges and the heat activatible adhesive on the corresponding interior surface portions of the lid panels are heated and then sealed together under pressure by a cooperating pair of rollers of the like. In the case of the sides, the heat activatible adhesive on the interior surface of the lid flaps and the heat activatible adhesive on the exterior surface of the side defining side wall panels are heated and then brought into contact. In the case of the ends, the heat activatible adhesive is provided as portions of the PET plastic film layer on the interior surfaces of the tray blanks and the lid blank. In the case of the sides, the heat activatible adhesive on the lid flaps is again portions of the interior plastic film layer whereas the heat activatible adhesive on the side defining the side wall panels is a water soluble heat activatible adhesive emulsion printed on the exterior surface of the side defining side wall panels.

The present invention is based upon the underlying concept that it is advantageous under many packaging situations to provide a packaging line which is capable of forming plural compartment packages as well as single compartment packages without the necessity of changing the system for closing the packages.

Accordingly, it is an object of the present invention to provide a carton package providing at least one compartment suitably closed to contain consumable contents therein for shipping and handling so that the contents can be (1) heated in an oven while retained therein in a vented condition and (2) thereafter consumed while retained therein in an accessed condition, the carton package comprising a plurality of blanks of carton material cut and scored so as to provide one or more compartments and a separate lid part for one or more tray compartments, each of the one or more tray compartments including, a bottom wall panel having a periphery defined by interconnecting side fold lines interrelated so that each adjacent pair of side fold lines extends at an angle with respect to each other from a corner point defining a corner of the bottom wall panel, side wall panels extending integrally from the side fold lines and interrelated so there are a plurality of pairs of adjacent side wall panels, the side wall panels being folded upwardly along the side fold lines and having outer edges defining an open top space for containing a consumable content, and an integral corner connection between each pair of adjacent side wall panels, the integral corner connection being folded and sealed so as to form leak-tight sealed integral corners for the open top space, the lid part including a planar rectangular lid panel defining the top of the package, the lid panel having a pair of opposed end edges defined by a pair of opposed parallel free marginal edge portions extending along the top of a pair of opposed ends of the package and a pair of opposed side edges defined by a pair of opposed parallel lid flap panel fold lines, the lid part also including a pair of lid flap panels integral with the pair of opposed side edges and folded downwardly along the lid flap panel fold lines in generally perpendicular relation to the planar lid panel so as to define substantially the entirety of a pair of opposed sides of the package, the planar rectangular lid panel provided by extending over the open top space provided by the one or more tray compartments with the one or more tray compartments presenting (1) side wall panels disposed along the pair of opposed package ends having integral flanges extending outwardly from the outer edges thereof and constituting end defining side wall panels and (2) side wall panels extending along the pair of opposed package sides constituting side defining side wall panels, the interior surface of the flanges and the interior surfaces of the lid panel free marginal edge portions being sealed together in pressurized abutting relation with heat activated adhesive therebetween, the exterior surfaces of the side defining side wall panels and the interior surface of the lid flap panels being sealed together in contact abutting relation with heat activated adhesive therebetween, the lid part having cuts therein for facilitating the manual venting and accessing of the tray compartment space provided by the one or more tray compartments.

It is a further object of the present invention is to provide a package having one or more tray compartments and a separate lid part which is simple in construction, economical to manufacture and assemble, and efficient in operation.

The invention may best be understood with reference to the accompanying drawings wherein an illustrative embodiment is shown.

IN THE DRAWINGS

Figure 1:
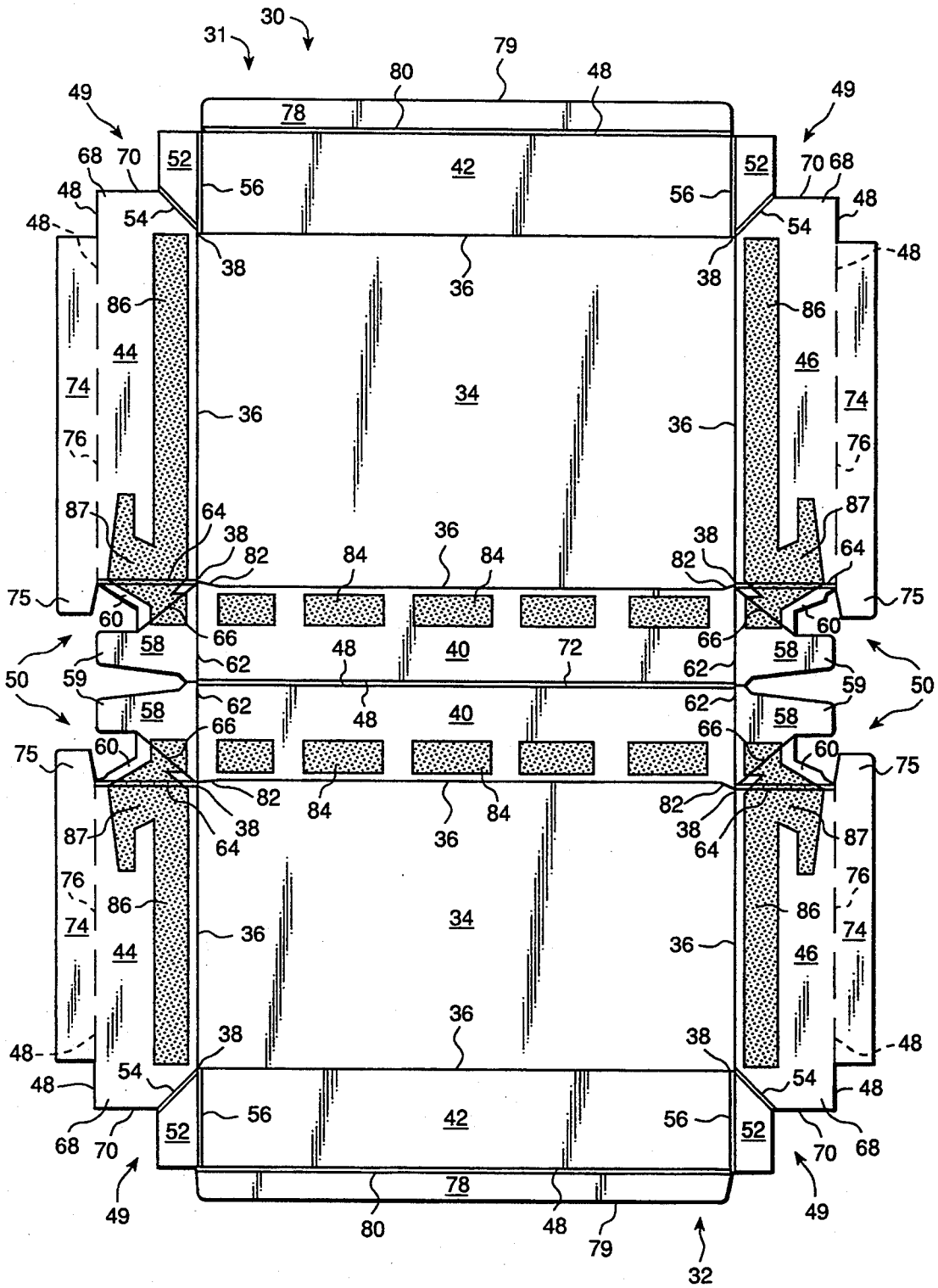
FIG. 1 is a plan view looking at the exterior surface of one embodiment of a carton tray blank capable of being constructed into a plural compartment carton tray of the carton package according to the principles of the present invention.

Referring now, more particularly, to FIG. 1 of the drawings, there is shown therein a carton tray blank, generally indicated at 30, which is erectable to form a plural compartment carton tray of the carton package embodying the principles of the present invention. The blank 30 is formed of any suitable carton material as, for example, paperboard. It will be understood that the carton material may be in the form of a laminate, such as a plastic film (e.g., polyester, polypropylene or PET) laminated to the paperboard. Preferably, the plastic film is on the interior of the paperboard blank although it may be provided on the exterior as well. The laminate may include, in selective portions throughout the paperboard material, a microwave susceptor material. The susceptor material may either be microwave-interactive or microwave-shielded material.

As shown, the blank material is suitably cut and/or scored from a sheet of carton material to provide a pair of tray compartment blank sections, generally indicated at 31 and 32. Each tray compartment section 31 and 32 consists of a bottom wall panel 34 defined peripherally by four interconnecting side fold lines 36 interrelated so that each adjacent pair of side fold lines extends at an angle with respect to each other from a corner point defining a corner 38 of the bottom wall panel 34. Each tray compartment section 31 and 32 also includes four side wall panels 40, 42, 44 and 46 arranged around the periphery of the bottom wall panels 34 such that side wall panels 40 and 42 form a first pair of opposing side wall panels and side wall panels 44 and 46 form a second pair of opposing side wall panels. Each side wall panel 40, 42, 44 and 46 includes outer edges 48 generally parallel to the side fold lines 36. The side wall panels 40, 42, 44 and 46 are integral with the bottom wall panel 34 along side fold lines 36 and interrelated so that there are a plurality of pairs of adjacent side wall panels. The side fold lines 36 may be of and desired construction, an exemplary embodiment being regular barscores as viewed from the side of the blank forming the exterior of the carton tray when erected. The side of the carton tray blank 30 shown in FIG. 1 corresponds to the exterior of the carton tray when erected. The regular barscores are illustrated in FIG. 1 by a solid line. The opposite side as that shown in FIG. 1 is also the side of the blank 30 on which the plastic film is adhered when the blank 30 is made of a laminate.

Each tray compartment section 31 and 32 includes four integral corner connections foldable to form sealable leak tight corner connections between each pair of adjacent side wall panels when the carton blank 30 is in an erected position. In an exemplary embodiment of the present invention, the integral corner connections are of two types identified separately and indicated generally at 49 and 50. The first type of integral corner connection 49 is provided between adjacent side wall panels 42 and 44 as well as adjacent side wall panels 42 and 46 forming the end corners of the carton tray when the blank 30 is erected. Each corner connection 49 includes a single gusset wall panel 52 integral with the side wall panel 44 or 46 along a first end fold line 54 and integral with an adjacent side wall panel 42 along a second end fold line 56. The first and second end fold lines 54 and 56 extend from an associated corner 38 in an angularly related relation with respect to one another. It is to be understood that the end fold lines 54 and 56 need not extend exactly from the corner 38, but may be offset therefrom to an extent generally equal to the thickness of the paperboard material. The first end fold lines 54, in an exemplary embodiment, are formed by reverse barscores, i.e., barscored on the side of the carton blank 30 opposite that shown in FIG. 1. Reverse barscores are illustrated in the Figures by parallel solid lines. The first end fold lines 54, in an exemplary embodiment, extend from a corner 38 at an angle of approximately 135° with respect to the adjacent side fold line 36. The second end fold lines 56, in an exemplary embodiment, are also formed by reverse barscores, and, in an exemplary embodiment, extend from an associated corner 38 at an angle of approximately 90° with respect to the associated side fold line 36.

The second type of integral corner connection 50 is provided between adjacent side wall panels 40 and 44 as well as adjacent side wall panels 40 and 46. The second type of integral corner connections 50 are formed along the sides of the carton tray when the carton blank 30 is erected. Each corner connection 50 includes first and second gusset wall panels 58 and 60 integral the associated side wall panels 40, 44, or 46. As shown, the first gusset wall panel 58 is integral with side wall panel 40 along a first end fold line 62 and the second gusset wall panel 56 is integral with either side wall panel 44 or 46 along a second end fold line 64. The first and second gusset wall panels 58 and 60 in each integral corner connection 50 are integral with one another along a central gusset fold line 66. The two end fold lines 62 and 64 and the central gusset fold line 66 extend from an associated corner 38 in an angularly related relation with respect to one another. It is to be understood that the fold lines 52, 64 and 66 need not extend exactly from the corner 38, but may be offset to an extent generally equal to the thickness of the paperboard material. In an exemplary embodiment, the first and second end fold lines 62 and 64 form an angle of approximately 90° with respect to the side fold line 36, and the central gusset fold lines 66 form an angle of approximately 135° with respect to either associated side fold line 36. The first end fold line 62 and central gusset fold line 66, in an exemplary embodiment, may be formed by regular barscores, while the second end fold lines 64 may be formed by reverse barscores. The first gusset wall panel 58 includes a protruding portion 59 integral therewith, the purpose of which is discussed below.

Each of the side wall panels 44 and 46 include end portions 68 at an end thereof proximate to the integral corner connections 49. The end portions 68 are defined by the associated first end fold lines 54 and peripheral edges 70 extending between the end fold lines 54 and the outer edges 48 of the side wall panels 44 and 46.

The compartment sections 31 and 32 are in a side-by-side relation with one another and integrally interconnected along an interconnection fold line 72 corresponding to the outer edges 48 of the side wall panels 40 adjacent one another. The interconnection fold line 72, in an exemplary embodiment, is reverse barscored. The side fold lines 36 that are generally parallel and located proximate to the interconnection fold line 72 include portions 82 offsetting these side fold lines 36 toward the interconnection fold line 72 to facilitate surface-to-surface contact between the exterior surfaces of the adjacent side wall panels 40 when the carton blank 30 is erected.

Side wall panels 44 and 46 include edge wall panels 74 formed integral therewith along edge wall panel fold lines 76 corresponding to a portion of the outer edges 48. In an exemplary embodiment, the edge wall panel fold lines 76 include perforation along the length thereof. Also, the edge wall panels 74 include protruding tab portions 75 at an end thereof proximate to the second type of integral corner connections 50.

The outermost side wall panels 42 in the first pair of side wall panels include flanges 78 integral therewith along edge wall panel fold lines 80 corresponding to the outer edges 48 thereof. In an exemplary embodiment, the fold lines 80 are reverse barscored enabling the flanges 78 to be outwardly folded with respect to the interior surface bottom wall panels 34 forming a pair opposing flanges on an outer edge of the end defining side wall panels 42 when the carton blank 30 is erected.

The carton blank 30, in a preferred embodiment, includes strips of adhesive 84 provided on a portion of the exterior surface of at least one of the adjacent side wall panels 40. As shown, the strips of adhesive 84, in an exemplary embodiment, are disposed on an exterior surface portion of both side wall panels 40 generally parallel to the adjacent side fold lines 36. It is to be understood that the strips of adhesive 84 may be disposed on the side wall panels 40 in any desired configuration. In the preferred embodiment of the present invention, however, the adhesive is provided in a series of strips or spots that parallels the side fold lines 36. The space between the strips of adhesive enables a forming member to contact the paperboard at these locations during the erecting procedure so that a stream of hot air can be applied locally to the strips of adhesive 84 thereby activating the strips of adhesive 84 for forming a bonding relation between adjacent side wall panels 40.

An adhesive 86 is also provided on an exterior surface portion of the side wall panels 44 and 46, an exterior surface portion of the second gusset wall panel 60, and an exterior surface portion of the first gusset wall panel 58 in the pattern shown. It is to be understood that while a single strip of adhesive 86 is shown, the adhesive 86 may be separately disposed at the above-identified locations. Also, various other configurations for the adhesive 86 are contemplated by the present invention.

Figure 2:
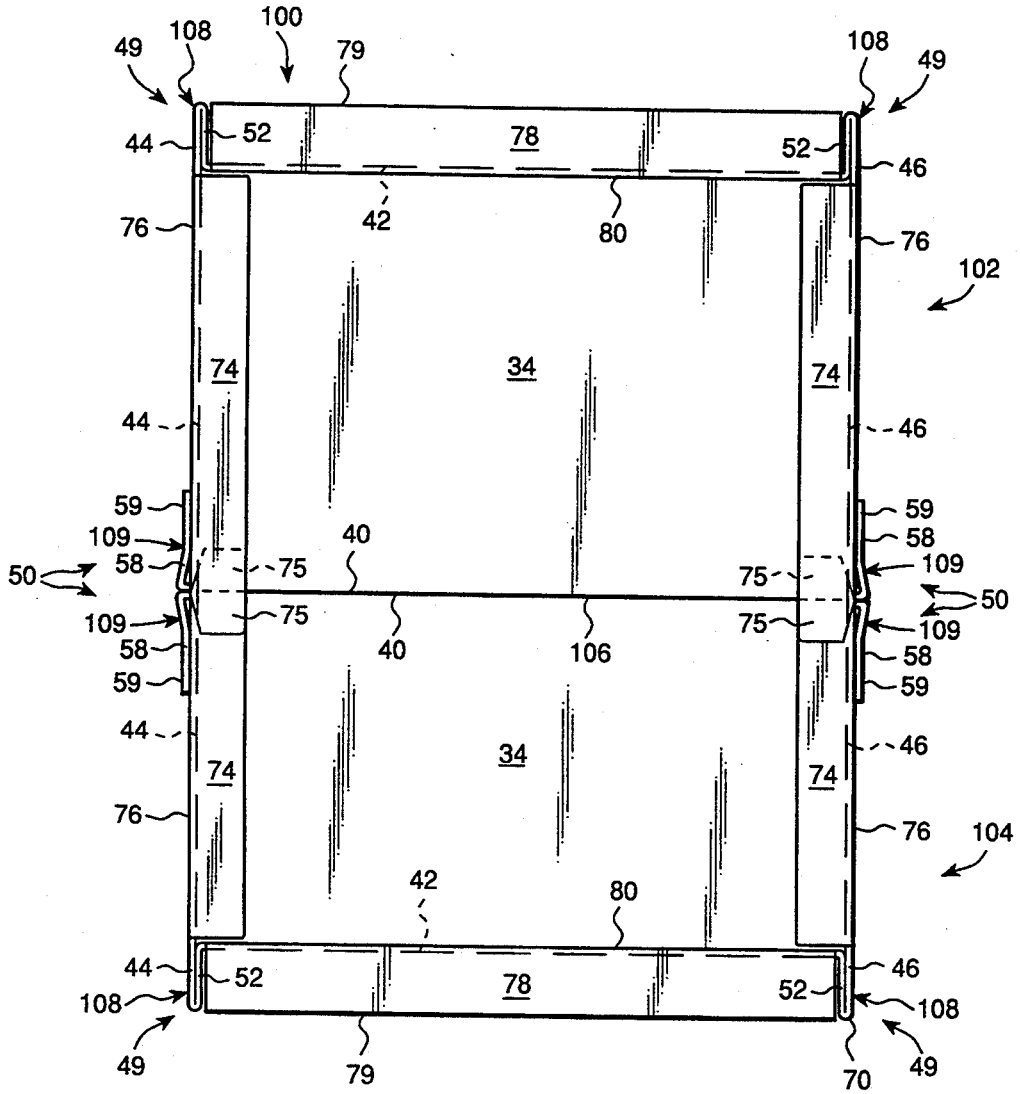
FIG. 2 is a top plan view of a plural compartment carton tray constituted from the carton tray blank shown in FIG. 1.
Figure 3:
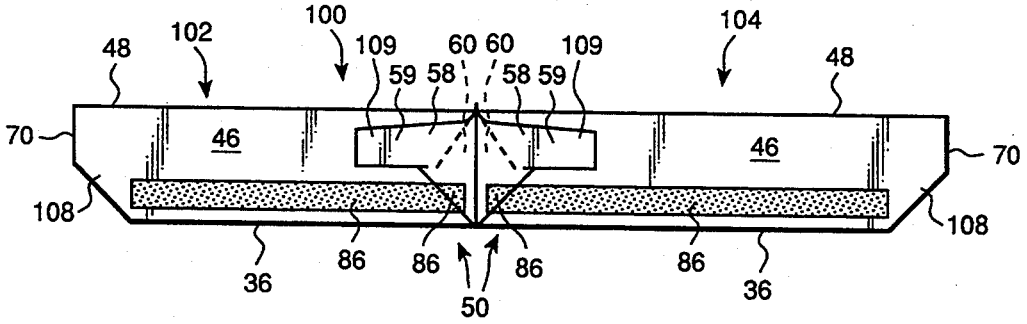
FIG. 3 is a front side view of the plural compartment carton tray shown in FIG. 2.

Referring now to FIGS. 1–3, the method in which the carton blank 30 is erected to form a plural compartment carton tray, generally indicated at 100, is discussed below, wherein like numerals identify identical parts as those illustrated in FIG. 1. FIG. 2 is a top plan view, and FIG. 3 is a front side view of the plural compartment carton tray erected from the carton blank of FIG. 1. Each generally rectangular-shaped compartment of the carton tray 100 is erected by upwardly folding the side wall panels 40, 42, 44 and 46 in a uniform direction relative to the bottom wall panels 34 along the side fold lines thereby defining an open top space for containing consumable contents therein. The plural tray compartment 100 consists of the separate tray compartments, generally indicated at 102 and 104, arranged in side-by-side relation.

The side wall panels 40 in the interior of the carton tray 100 are folded along the integral interconnecting fold line 72 to thereby define a partition 106 between the two compartments 102 and 104. In an exemplary embodiment, the partition 106 is formed perpendicular to the bottom wall panels 34. It is to be understood that the partition defining side wall panels 40 may be spaced apart from one another by a portion of carton material integral with and extending between the outer edges of the adjacent side wall panels 40. Also, an insulating material or the like may be provided between the adjacent side wall panels 40 for thermally isolating each of the compartments.

The ends of the tray 100 are defined by end defining side wall panels 42, which are generally parallel to the partition defining side wall panels 40. The sides of the tray are defined by side defining side wall panels 44 and 46, and are generally perpendicular to the partition defining side wall panels 40. Spaced end corners 108 in the periphery of the carton tray 100 are formed by the integral corner connections of the first type 49, while side corners 109, disposed along the sides of the tray 100, are formed by the integral corner connections of the second type 50.

The end corners 108, disposed along the exterior periphery of the tray 100, are erected concurrent with the folding of the side wall panels by progressively folding the gusset wall panels 52 along the angularly related end fold lines 54 and 56 in opposite directions with respect to the associated pair of adjacent side wall panels so as to bring each gusset wall panel 52 into a surface-to-surface abutting relation with the interior surface of the end portions 68 of the side wall panels 44 and 46 to thereby form the end corners 108. The end corners 108 are defined (1) exteriorly by the associated gusset wall panels 52 adhesively adhered in abutting relation to the end portions 68 of the associated side wall panels 44 and 46 with the associated end fold line 54 extending generally in the plane of the associated side wall panels 44 and 46 from the associated corner 38 and (2) internally by the associated end fold lines 56 extending from the associated corners 38 along the surface of the associated side wall panels 44 and 46.

The gusset wall panels 52 are adhesively sealed to the end portions 68 of the side wall panels 44 and 46 by an adhesive. The adhesive utilized may be any type including either heat activated or pressure activated adhesive. The adhesive may be separately applied to the appropriate portion of the carton blank 30 prior to or during carton blank erecting procedure. It is to be understood that where the carton material comprises a laminate including a plastic film on the interior surface portions of the paperboard, portions of the plastic itself may constitute the adhesive which is activated by heat, and preferably by directing a stream of hot air or the like locally thereto during the erecting procedure.

The side corners 109 are formed during the folding the side wall panels by first folding the end fold line 62 into a superposed relation with the second end fold line 64 so as to form a single superposed end fold line. The first and second gusset wall panels 58 and 60 are next folded together in a surface-to-surface abutting relation along the central gusset fold line 66. The two abutted together gusset wall panels are then folded together along the superposed end fold line so as to bring the exterior surface of the second gusset wall panel 60 into a surface-to-surface abutting relation with an end portion 87 of the associated side wall panel 44 or 46, depending on the side of the tray the corner connection 50 is located. The protruding portion 59 of the first gusset wall panel 58 extends beyond the edge of the second gusset wall panel 60. As a result, the interior surface of the protruding portion 59 is in a surface-to-surface abutting relation with the exterior surface of the end portion 87 of the side wall panels 44 or 46. The two abutted together gusset wall panels, once folded, lie in a plane generally parallel to the sides of the tray 100 so as not to extend significantly therefrom. It is to be understood that the two abutted together gusset wall panels 58 and 60 in the one of the side corners 109 in the pair of side corners along one side of the tray 100 can be folded to overlap the side defining side wall panel and associated folded side corner of the adjacent compartment, rather than being folded against the end portion of the associated side wall panel in the same compartment to which the gusset wall panels 58 and 60 are attached. Such a configuration is disclosed in U.S. Pat. No. 4,944,451. In this manner the gusset wall panels serve to further rigidify the connection of the compartments at the partition. An adhesive may be provided to maintain the abutted together gusset wall panels in an overlapping relation with the end portion 87 of the adjacent side defining side wall panel.

The two abutted together gusset wall panels are maintained in the surface-to-surface abutting relation with the side wall panels 44 and 46 by the adhesive 86 provided on the exterior surface of the end portions 87 and the exterior surface portion of the second gusset wall panel 60. While the adhesive 86 is illustrated in FIG. 1 as being provided of both the exterior surfaces of the second gusset wall panel 60 and the end portion 87 of the side wall panels 44 and 46, it to be understood that the adhesive 86 may be provided on only one of the second gusset wall panel 60 of the associated side wall panel 44 or 46. The two abutted together gusset wall panels are also maintained in the surface-to-surface relation by the adhesive 86 provided on the portion of the end portion 87 of the side wall panels 44 and 46 corresponding to the location of the protruding portion 59 when the corner connection 50 is erected. It is to be understood that where the carton blank material includes a laminate on the interior surface thereof, the laminate on the interior surface of the protruding portion 59, having been made tacky by applying heat thereto, may additionally serve to form the bonded relation therebetween.

Figure 5:
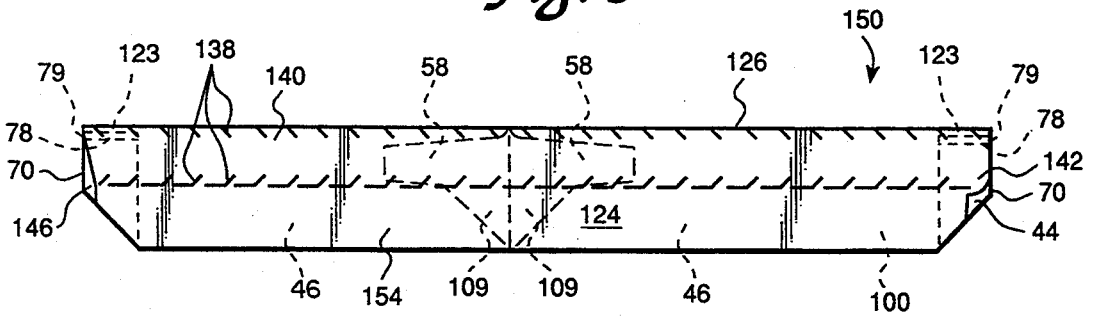
FIG. 5 is a front side view of a carton package including the carton lid blank shown in FIG. 4 enclosing the plural compartment carton tray shown in FIGS. 2–3.
Figure 6:
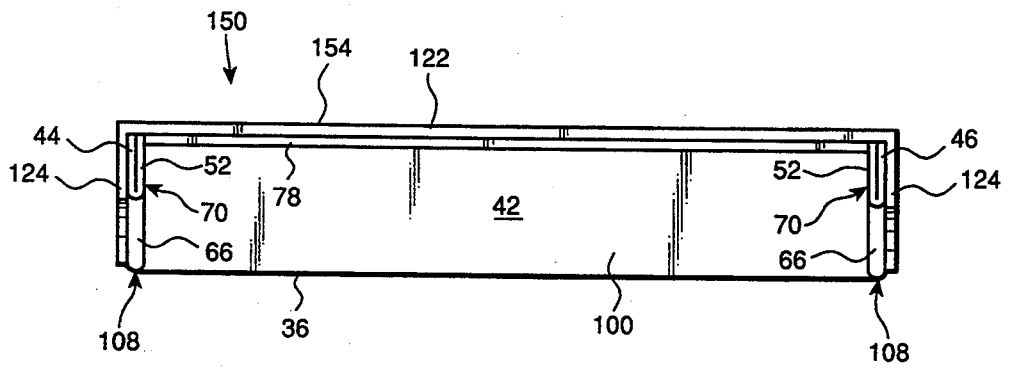
FIG. 6 is an end view of the carton package shown in FIG. 5.

As shown in FIG. 3, the adhesive 86 is also provided on the exterior surface of the first gusset wall panel 58 such that the adhesive matches the adhesive provided on the exterior surface of the side wall panels 46 and 44 when the side corners 109 are in an erected position (side wall panel 44 is not shown in FIG. 3). As a result, the lid flap panels 124 of the lid part 154 may be adhered to the sides of the plural compartment carton tray 100 substantially along the length thereof (see FIG. 5).

Referring again to FIGS. 1–2, in an exemplary embodiment of the present invention, the adhesives 84 and/or 86 are heat seal coating type adhesives that are capable of being printed on the above-identified surfaces prior to commencement of the carton blank erecting procedure such that the adhesives 84 and 86 dry in a non-tacky condition and are activated into a tacky condition by a stream of hot air applied thereto during the erecting procedure. Once activated the heat seal coating type adhesive is capable on bonding the two surfaces on contact. Adhesives having these characteristics are known. For example, U.S. Pat. No. 5,217,159 discloses adhesives suitable for use in the present application. A particular type of adhesive suitable for the purposes of the present application is a water base modified acrylic type adhesive having the following characteristics.

| | |
|---|---|
| viscosity | 20–30 sec. Zahn 2 @ 80° F. |
| weight per gal. | 8.97 ± 0.10 lbs. |
| lbs solid per gal. | 4.2 |
| solids (% by weight) | 46.0–47.5 |
| boiling point | 212° F. |
| vapor pressure (mm hg at 77° F.) | 24.0 |
| vapor density (air = 1.0) | 0.6 |
| specific gravity | 1.06 |
| drying conditions | 120 to 140° F. board temp. (10" at approx. 250° F.) |
| evaporation rate (butyl acetate = 1) | 0.4 |

Such an adhesive is manufactured by the Valspar Corp. of Pittsburgh, Pa., under the tradename "91W158B WB Acrylic".

Another suitable adhesive is an ethylene vinyl acetate type heat seal coating adhesive, which is a low heat activating, water based dispersion that is based on high molecular weight ethylene interpolymers and has the following characteristics.

| | |
|---|---|
| viscosity | 150 cps @ 77° F. |
| solids | 45.5% |
| density | 8.09 lbs/gal. |
| boiling point | 212° F. (approx.) |
| pH | 10 |
| vapor density (air = 1.0) | 1.0 |
| specific gravity | 0.971 |
| dilutent | deionized water |
| dry coating weight per 3000 sq. ft. | 1.5–2.0 lbs. |
| drying temp. | 150° F. to 180° F. |

Such an adhesive is manufactured by Morton International of Chicago, Ill., under the tradename "Adcote 154-55".

Still another water based heat seal coating suitable for purposes of the present invention has the following characteristics.

| | |
|---|---|
| viscosity | 150–300 cps @ 77° F. |
| solids | 34.5% |
| weight per gal. | 8.3 lbs. |
| pH | 10 |
| solvents | water |
| diluents | water |
| recommended application solids | 32–34% |
| recommended coating weight | 2.0–2.5 dry lbs/ream |
| drying temp. | 140–150° F. |

This adhesive is also manufactured by Morton International of Chicago, Ill., under the trade name "Adcote X19-7".

As shown in FIGS. 1–3, in a preferred embodiment, the edge wall panels 74 are folded along their respective edge wall panel fold lines 76 inwardly with respect to the associated bottom wall panel 34. Also, the flanges 78 are folded outwardly along fold lines 80 with respect to the associated bottom wall panel 34 to thereby form opposing flanges 78 at the ends of the tray 100.

Figure 4:
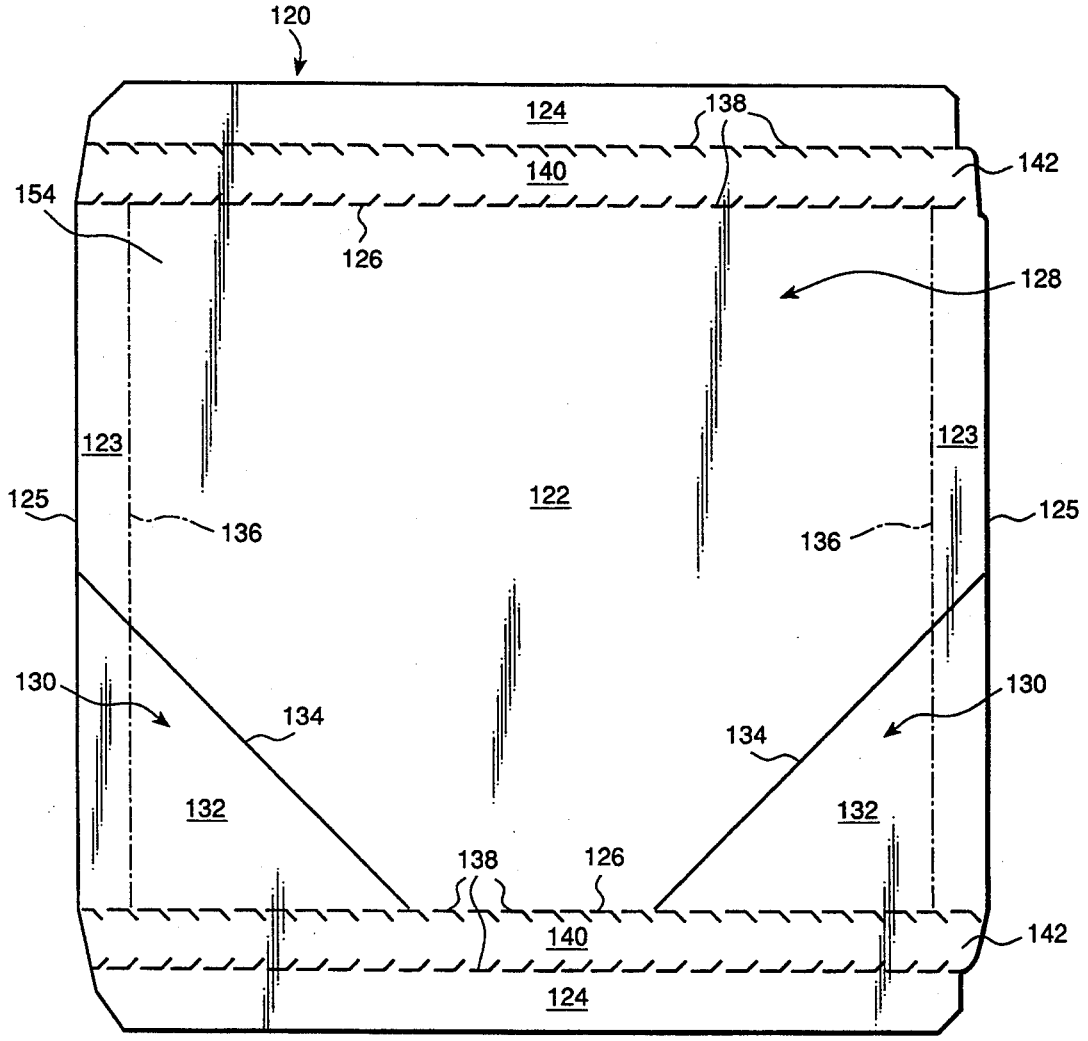
FIG. 4 is a top plan view of a carton lid blank capable of enclosing the carton tray shown in FIGS. 2–3 according to the principles of the present invention.

Referring now to FIG. 4, there is shown therein a lid blank, generally indicated at 120, suitable to enclose the compartments 102 and 104 of the tray 100 (FIG. 2) formed from the carton blank 30 shown in FIG. 1. The lid blank 120 is cut and/or scored from a sheet of carton blank material and foldable to form the lid part 154 of the carton package 150 (FIGS. 5–8). The lid blank 120 includes a planar rectangular lid panel 122 having side edges defined by lid flap panel fold lines 126 and a pair of opposed end edges 125 defined by a pair of opposed parallel free marginal end portions 123. The opposed marginal edge portions 123 extend between the ends of the lid flap panel fold lines 126 and are defined on each side by edges 125 of the lid panel 122 and partial depth cuts 136 in the interior surface of the lid panel 122. The lid blank 120 also includes a pair of opposing lid flap panels 124 integral therewith along the pair of opposed side edges defined by the lid flap panel fold lines 126.

The partial depth cuts 136 also serve to define an eating access section, generally indicated at 128, and a venting section, generally indicated at 130, for each compartment of a carton tray. The cuts 136 enable a portion of the lid panel 122 to be moved to provide eating and venting access to the contents of each compartment. More specifically, the venting access section 130 for each compartment is formed in a corner portion 132 of the lid panel 122 defined by a diagonal fold line 134, which is preferably regular barscored as view form the side of the lid panel 122 corresponding the exterior surface of the carton package. The diagonal fold line 134 extends between the edges 125 of the lid panel 122 and the lid flap panel fold line 126. The partial depth cuts 136 in the interior surface of the lid panel 122 enable the lid panel to be delaminated along a path corresponding to the marginal edge portions 123. To vent each compartment as the contents therein are heated in an oven, the corner portion 132 is folded outward from the carton package to a venting position.

Figure 7:
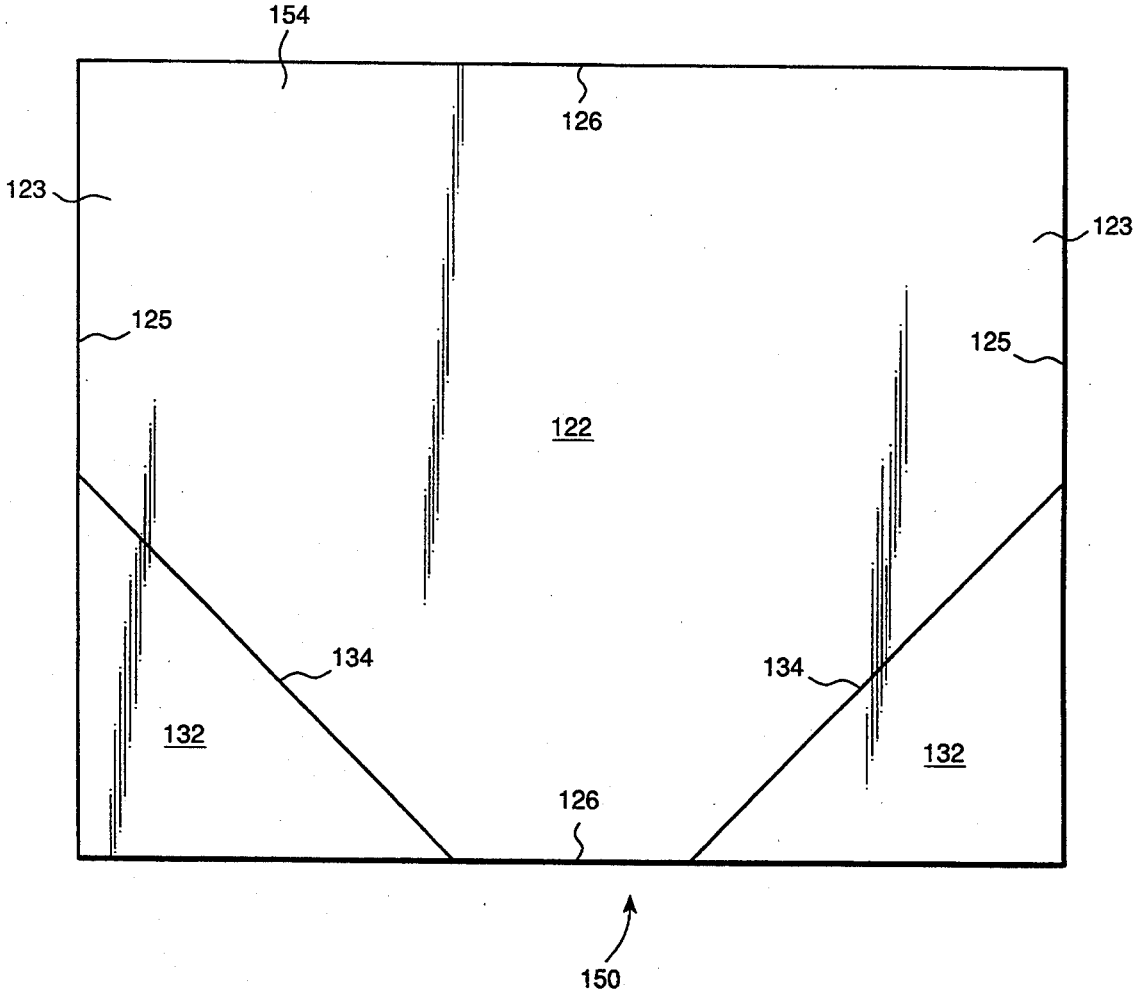
FIG. 7 is a top plan view of the carton package shown in FIGS. 5–6.
Figure 8:
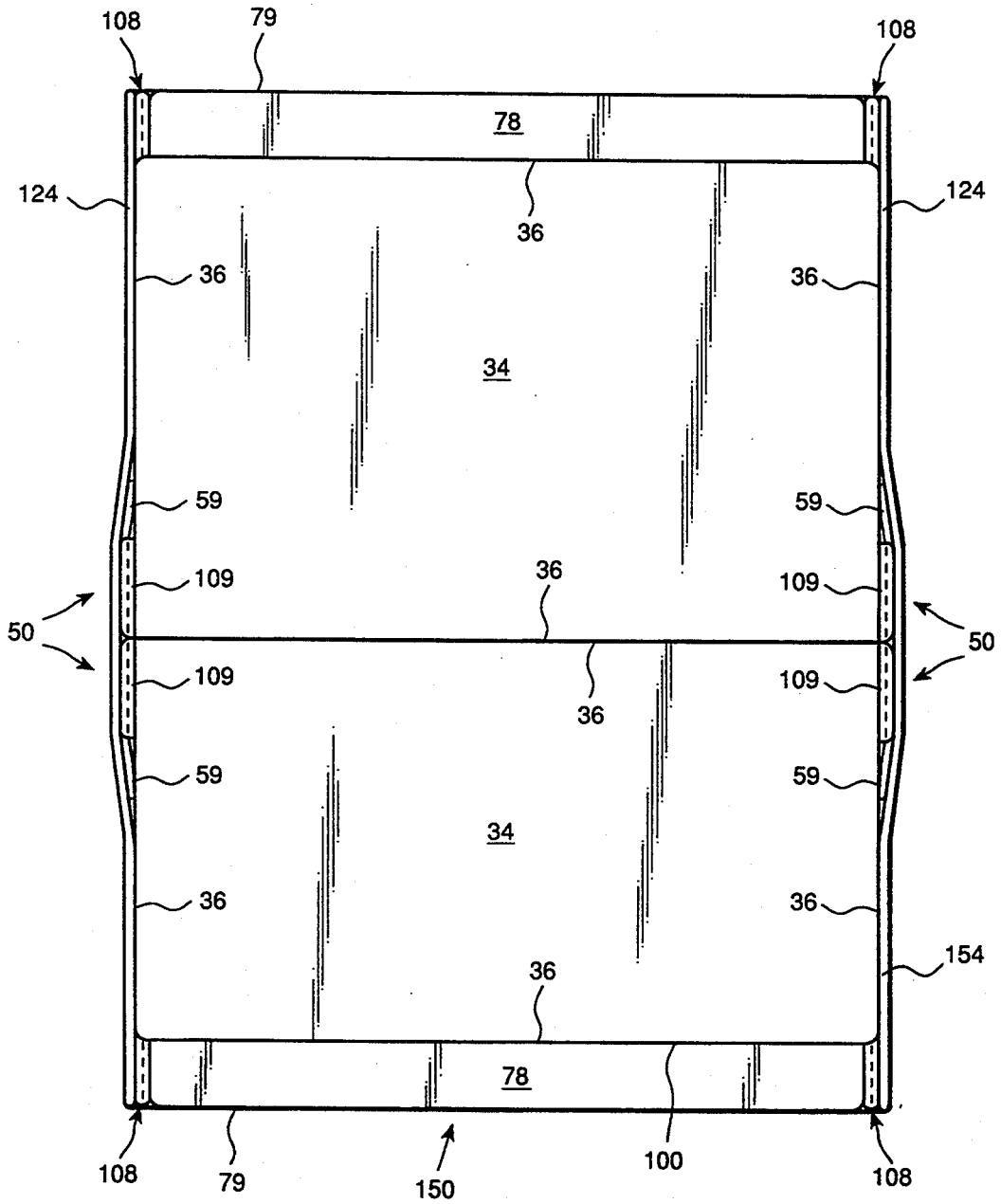
FIG. 8 is a bottom plan view of the carton package shown in FIGS. 5–7.

As previous stated, the interior partial depth cuts 136, which are illustrated in FIG. 7 by a solid line broken with a short dash, also provide an eating access to the contents of the compartments. As shown, the eating access section 128 of the lid blank 120 for all the plural compartments includes substantially the entire lid wall panel 122. Thus, the partial depth cuts 136 enable substantially the entire lid panel 122 to be removed from the carton package to thereby provide eating access to the contents of the compartments.

Preferably, the lid blank 120 is constructed so as to be simply and conveniently manually disconnectable from the plural compartment carton tray 100 (FIG. 2) to an extent sufficient to provide (1) a vent for the consumable contents in one or both of the compartments while being heated in an oven and (2) eating access to the heated contents of each tray when removed from the oven. Preferably, the two functions are performed in sequence. However, it will be understood that an extent of disconnection sufficient to provide access to the heated contents will automatically provide sufficient disconnection for a vent. Consequently, in the broadest aspects of the present invention, the means in the lid part for facilitating manual disconnection of a portion of the lid part from the carton tray can be a simple means. It is preferred, however, to provide two separate means which are capable of operation in sequence to provide first a vent and then access. Nevertheless, in its broadest aspects, the present invention contemplates elimination of facilitating means in favor of venting and access by means of a tool, such as a sharp knife or the like.

As shown in FIG. 4, which illustrates the preferred arrangement for the structure that enables a portion of the lid flap panels 124 to be disconnected from the tray, it can be seen that the lid flap panels 124 include a series of parallel cuts 138 defining tear-away strips 140 within a portion of the lid flap panels 124 adjacent the lid flap panel fold line 126. Indeed, the innermost series of cuts 138 form the majority of the associated lid flap panel fold line 126. The operation of the tear-away strip to provide access to the vent access section for each compartment and thereafter to disconnect at least a portion of the lid part from the carton tray thereby providing eating access to the contents in each compartment is discussed below.

Referring now to FIGS. 5–8, there is shown therein a carton package, generally indicated at 150, formed by enclosing the plural compartment carton tray 100 (FIGS. 2–3) with the lid part 154 formed from the lid blank 120 (FIG. 4), wherein like numerals identify like parts as those illustrated in previous Figures. To enclose the open top spaces of the carton tray, the lid flap panels 124 are downwardly folded along the lid flap panel fold lines into a generally perpendicular relation to the planar lid panel 122, which has an area greater that the combined area of the open top spaces of the tray compartments. The lid part 154 extends over the open top spaces of the plural compartment carton tray 100 in a generally closing relation with the tray compartments being disposed in side-by-side relation therebelow. The side defining side wall panels 44 and 46, including the side corners 109, are substantially overlapped by the downwardly folded lid flap panels 124, thereby defining substantially the entirety of the pair of opposed sides of the carton package 150. Such a configuration is disclosed in application Ser. No. 07/964,870, filed on Oct. 22, 1992, in the name of Richard F. Gulliver and James R. Green for a FOOD PACKAGE CONTAINING SEPARATE TRAYS CONNECTED TOGETHER BY A SINGLE LID STRUCTURE, which is hereby incorporated by reference into the present specification. The lid flap panels folded in this manner provide a substantially smooth unitary exterior surface along the package side on which indicia can be placed, thus enabling the indicia to be clearly displayed thereon in an uninterrupted fashion. Furthermore, the smooth sides and perpendicular relation of the side wall panels 44 and 46 to the bottom wall panels 34 enable the carton packages 150 to be easily and conveniently stacked on their sides without the use of display stands or the like. Adhering the lid flap panels 124 over the side defining side wall panels also rigidifies the connection of the tray compartments at the partition 106, thereby providing a more stable carton package.

In this configuration, the carton tray end defining the side wall panels 42 are disposed along the opposed package ends and also constitute end defining side wall panels of the carton package 150. The side wall panels 44 are disposed along one side of the tray 100, while the side wall panels 46 are disposed along the other side thereof. The side wall panels 44 and 46 defining the carton tray sides also constitute the side defining side wall panels of the carton package 150. It can be seen that the number of side wall panels 44 and 46 defining a side of the carton package equals the number of tray compartments. Also, it is to be understood that additional compartments may be provided in side-by-side relation with the existing compartments. In which case, the number of side wall panels defining the sides of the carton package will increase to equal the number of tray compartments. However, the ends of the carton package will always be defined by the outer most side wall panels at the ends of the carton tray. The remaining side wall panels are interiorly disposed within the carton package 100 and generally extend between the pair of opposed sides of the package 150 thereby defining the partition between adjacent compartments.

The lid flap panels 124 are maintained against the side defining side wall panels 44 and 46 by the adhesive 86 provided on the exterior surface of the side wall panels 44 and 46 and the adhesive provided on the exterior surface of the first gusset wall panel 58 (FIG. 3). It is to be understood, however, that the present invention contemplates the application of adhesive 86 to the side wall panels 44 and 46 and the first gusset wall panels 58 in any pattern sufficient to enable the lid flap panels 124 to be adhered thereto. Also, the adhesive may be eliminated from the first gusset wall panels 58. The adhesive utilized may of the same type, and used in the same manner, as discussed above for adhering the two abutted together gusset wall panels 58 and 60 to the side wall panels 44 and 46 in the side corners 50 along the sides of the tray 100. Furthermore, where the lid part 154 includes a laminate provided on the interior surface thereof, the laminate may also serve to adhere the lid flap panels 124 to the sides of the plural compartment carton tray 100. It is to be understood that where the partition defining side wall panels 40 are spaced apart from one another by a portion of carton material integral with and extending between the outer edges of the adjacent side wall panels 40, the interior surface of the lid panel 122 may be adhesively adhered to the upper surface of the portion of carton material bridging the gap between the partition defining side wall panels.

The end defining side wall panels 42 include integral flanges 78 extending outwardly therefrom and generally parallel to the bottom wall panel 34. The flanges 78 are adhesively adhered to the interior lid panel surface along the marginal edge portions 123. The flanges 78 are stabilized by the lid flap panel fold lines 126 extending between the outer edges 79 of the flanges 78 such that the ends of the lid flap panels 124 extending therefrom connect the ends of the flanges 78 to the end corners 108 of the carton package 150. This added stability strengthens the handling capability of the flanges, thereby enabling the carton packages to be more safely gripped at the flanges, which is especially important when removing the heated contents from the oven.

The inwardly folded edge wall panels 74 (FIG. 2) engage the interior surface of the lid panel 122 proximate to the lid flap panel fold lines 126 thereby enhancing the sealing characteristics of each compartment along the sides of the carton package. It is to be understood, however, that any number of the edge wall panels may be eliminated depending on the desired sealing characteristic of the lid part 154 to the carton tray 100. In its broadest aspects, the present invention contemplates the elimination of all the edge wall panels.

Figure 10:
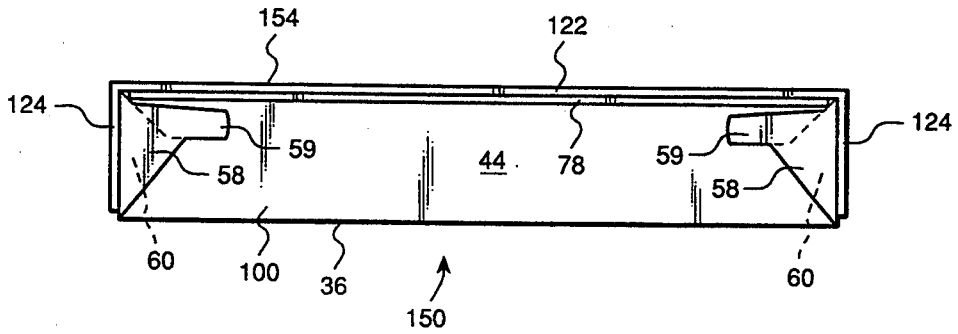
FIG. 10 is an end view of yet another embodiment for the end corner connections according to the principles of the present invention.
Figure 9:
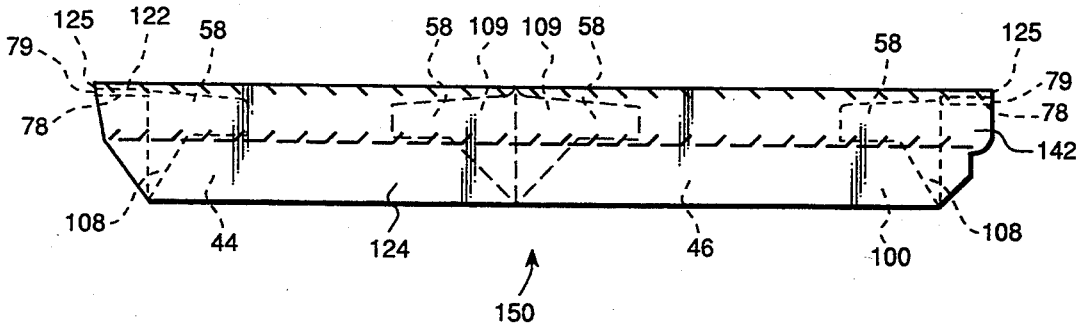
FIG. 9 is a front side view of a second embodiment of end corners of the carton package according to the principles of the present invention.

Other embodiments of the end corners 108 are illustrated in FIGS. 9 and 10, wherein the single-gusset type integral corner connections at the end corners 108 of the carton package 150 have been replaced with a double-gusset type corners. FIG. 9 illustrates a carton package 150 wherein the two abutted together gusset wall panels of the double gusset-corners are folded against and adhesively adheres to the side wall panels 44 and 46 defining the sides of the carton package 150. In the arrangement, the flanges 78 are stabilized in the same manner discussed above. Specifically, the lid panel 122 is flush with the ends 79 of the flanges 78 and is adhered thereto. The ends of lid flap panels 124 extend from the edges 125 of the lid panel 122 and are adhesively to the end portion of the side wall panels 44 and 46 proximate thereto, thus supporting the flanges 78. In FIG. 10, the same type of end corner 108 as that of FIG. 9 is shown. In FIG. 10, however, the two abutted together gusset wall panels are folded against and adhesively adhered to the end defining side wall panels 42.

Figure 11:
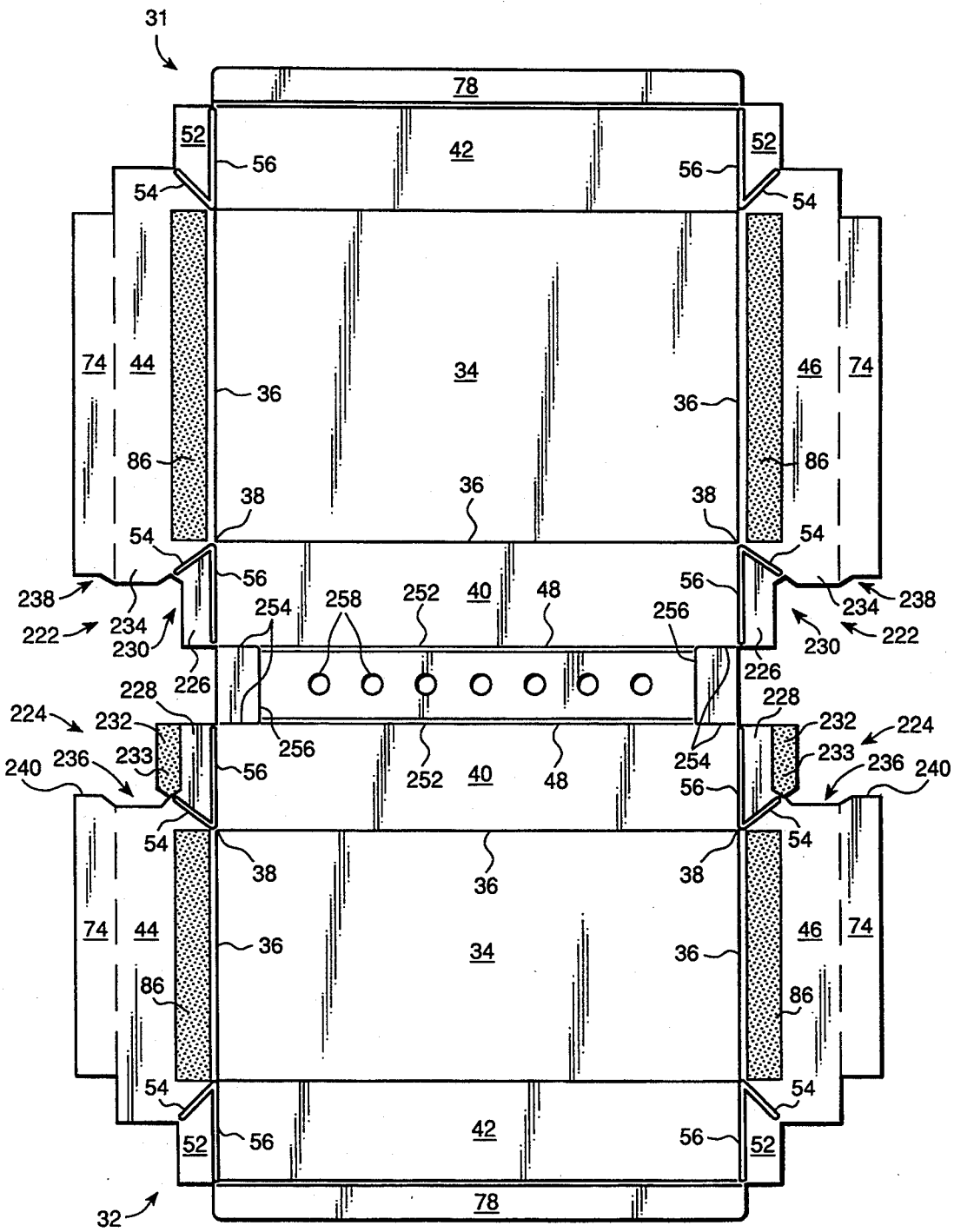
FIG. 11 is a plan view looking at the exterior surface of a second embodiment of a carton blank according to the principles of the present invention.
Figure 12:
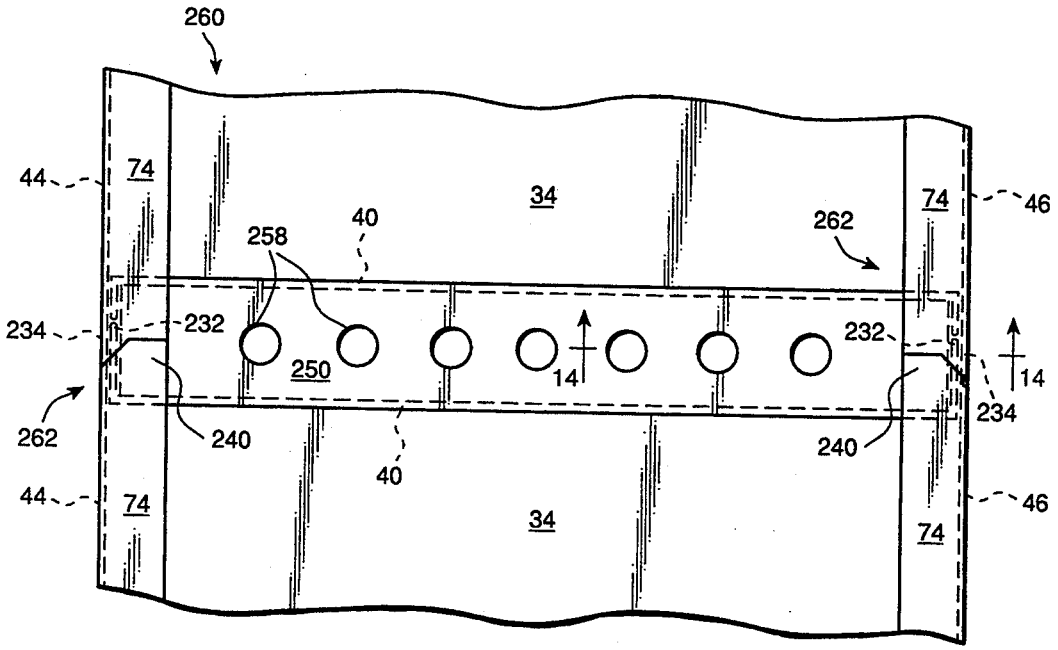
FIG. 12 is a fragmented top plan view of a carton tray constituted from the carton blank shown in FIG. 11.
Figure 13:
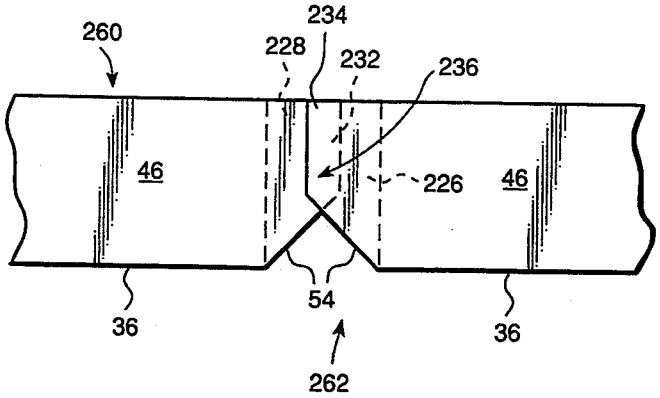
FIG. 13 is a fragmented front side view of the carton tray constituted from the carton blank shown in FIG. 11.
Figure 14:
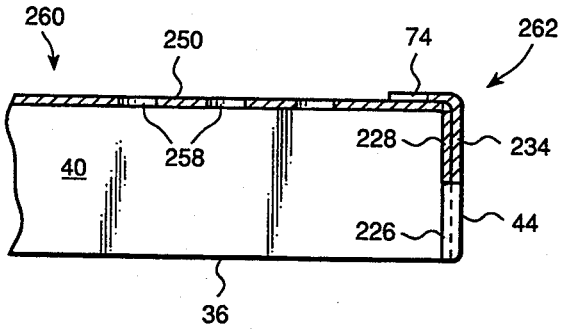
FIG. 14 is a fragmented cross-sectional end view of the interlocking corners of the carton tray constituted from the carton blank shown in FIG. 11.

Referring now to FIG. 11, there is shown therein a second embodiment of a carton tray blank 220 constructed according to the principles of the present invention, which can be used in lieu of the first carton tray blank 30 previously described with the carton lid blank 120 to form a carton package 260 similar to the carton package 100 except for the differences in the trays. The carton tray blank 220 is similar in most respects to the carton tray blank 30 and differs only in the center construction. Consequently, like parts as those described in previous figures are identified with like numerals. In this embodiment, all of the integral corner connections are of the first type 49 described above. That is, each corner connection incudes a single gusset wall panel folded into surface-to-surface abutting relation with an end portion of an associated side wall panel. In this embodiment, however, the integral corner connections forming the side corners of the carton package are interlockingly overlapped thereby rigidifying the interconnection of the separate compartments.

As shown, a first integral corner connection 222 is associated with compartment section 31, and a second integral corner connection 224 is associated on the adjacent compartment section 32. First and second integral corner connections 222 and 224 include a single gusset wall panel 226 and 228, respectively. In each integral corner connection 222 or 224, the gusset wall panel 226 or 228 is integral with the side defining side wall panels 44 or 46 and partition defining side wall panel 40 along first and second end fold lines 54 and 56, respectively. The first and second end fold lines 54 and 56 extend from an associated corner 38 in an angularly related relation with respect to one another. It is to be understood that the end fold lines 54 and 56 need not extend exactly from the corner 38, but may be offset therefrom to an extent generally equal to the thickness of the paperboard material. The first end fold lines 54, in an exemplary embodiment, are formed by reverse barscores and extend from a corner 38 at an angle of approximately 135° with respect to the adjacent side fold line 36. The second end fold lines 56, in an exemplary embodiment, are also formed by reverse barscores, and extend from an associated corner 38 at an angle of approximately 90° with respect to the associated side fold line 36.

The gusset wall panel 226 in the first integral corner connection 222 includes a recess 230 therein. The gusset wall panel 228 in the second integral corner connection 224 includes a protruding portion 232, which extends beyond the end of the first end fold line 54. The exterior surfaces of the protruding portions 232 are printed with strips of heat activated adhesive emulsion 233 of the type previously described. The side wall panel 44 associated with the first integral corner connection 222 includes a protruding portion 234, while the side wall panel associated with the second integral corner connection 224 includes a recessed portion 236 therein. Also, the edge wall panel 74 associated with the side wall panel 44 or 46 of the first integral corner connection 222 includes a recess 238 therein, and the edge wall panel 74 associated with the side wall panel 44 or 46 of the second integral corner connection 224 includes a protruding portion 240.

The outer edges 48 of the side wall panels 40 are integrally interconnected to a bridge portion 250 along fold lines 252, which extend between the second end fold lines 56 of the integral corner connections. In an exemplary embodiment of the present invention, the fold lines 252 are formed by reverse barscores as viewed from the side of the carton blank 220 forming the exterior of the carton package. The end portions 254 of the fold lines are regular barscores. A regular barscore 256 also extends along the width of the bridge portion 250 between the fold lines 252 at end portions thereof. A plurality of openings 258 are provided in the bridge portion 250, the purpose of which is discussed below.

Referring now to FIGS. 11–14, the carton blank 220 is erected into a carton tray 260 in the same manner as discussed previously with respect to the first embodiment of the present invention. When erected, the first and second integral corner connections 222 and 224 are in an overlapping relation thereby forming a pair of interlocking side corners 262 which are sealed together by the heat activated adhesive therebetween. The heat activated adhesive includes the printed adhesive strips 233 and the exterior surface of the protruding portions 232 and the plastic layer on the interior surface of the blank 220. It will also be understood that heat is applied to the adhesive areas just prior to moving the parts in overlapping relation to form the sealed interlocked side corners 262. More specifically, the gusset wall panels 226 and 228 are folded into surface-to-surface abutting contact with the interior surface of the side defining side wall panel 44 or 46.

The pair of interlocking side corners are formed by fitting the protruding portion 232 of the gusset wall panel 228 into the recess 230 of the gusset wall panel 226. Similarly, the protruding portion 234 of the side wall panel 44 in the first integral corner connection 222 fits into the recess 236 in the side wall panel 44 of the second integral corner connection 224. The protruding portions 234 and 232 overlap one another to form the interlocking side corner 262. The protruding portions 234 and 232 are maintained in the overlapping relation by adhesively adhering the contacting surfaces of these protruding portions together in the manner previously described.

Furthermore, the protruding portion of the edge wall panel 74 associated with the second integral corner connection 224 fits into the recess 238 in the edge wall panel 74 associated with the first integral corner connection 222. As shown, the edge wall panels 74 are inwardly folded toward the interior of the carton tray 260 so as to overlap the bridge portion 250. This configurations provides added stability to the connection of the compartments. However, it is to be understood that the edge wall panels 74 can be terminated such that the end portions thereof do not overlap the bridge portion 250.

Figure 15:
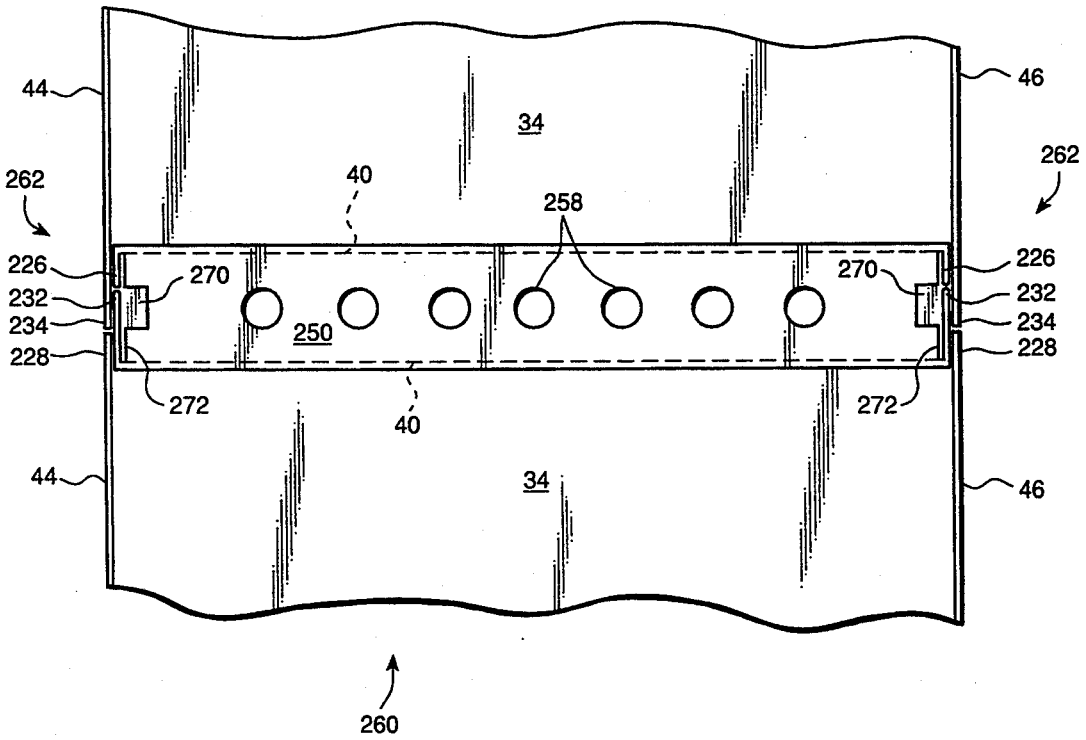
FIG. 15 is a fragmented top plan view of a second embodiment for the carton tray constituted from the carton blank shown in FIG. 11.

Referring now to FIG. 15, there is shown therein a top view of an alternative embodiment of the carton tray according to the principles of the present invention. FIG. 15 illustrates a carton tray 260, wherein the edge wall panels 74 have been eliminated from the side wall panels 44 and 46. A recess 270 is provided at the ends 272 of the bridge portion 250. The recess 270 enables a mandrel or the like located on the forming head of a plunger to be passed therethrough. The mandrel provides backing support for the interlocking side corners 262 so that opposing pressure can be applied to the overlapping portions thereof for sealing the interlocking side corners 262 in a bonded relation.

In an exemplary embodiment, the lid panel 122 is adhesively adhered to the upper surface of the bridge portion 250, thereby rigidifying the interconnection of the tray compartments and preventing leakage therebetween. The openings 258 in the bridge portion 250 enable hot air to be directed onto the interior surface of the lid panel to activate an adhesive, such as a plastic layer or laminate, provided thereon for adhesively adhering the lid panel 122 to the bridge portion 250.

The procedure for providing venting and eating access to each of the compartments is briefly discussed below with reference to FIGS. 4, 5, 7 and 9. It can be seen that by grasping the tab portion 142 of the tear away strip 140 and pulling slightly on the same, a portion of the associated lid flap panel 124 will become detached therefrom due to the perforations 138. The user is thus able to detach a sufficient length of the strip 140 enabling the corner portions 132 of the lid panel 122 to be moved to the venting position. This is accomplished by a slight upward force applied to the corner of the corner portion 132 thereby enabling the paperboard forming the lid panel 122 to delaminated between the interior fifty percent cuts 136 (FIG. 4) and the corresponding edges 125. Continued upward movement enable the corner portions 132 of the lid panel 122 to be deflected upwardly along the diagonal fold lines 134 sufficient to provide a vent for venting the contents of each compartment as the contents of the carton package are heated in an oven, as, for example, a microwave oven. After the contents have been heated and the carton package 150 removed from the oven, the user can then remove the other tear away strip in a similar manner so that the lid part is disengaged from the carton tray along the sides thereof. It then becomes a simple matter to continue to remove substantially the entire lid panel 122 by pulling on one of the deflected corner portions 132 and/or tab portions 142 so that the lid panel 122 is disconnected from the remainder of the package by the delamination of the lid panel 122 between the interior fifty percent cuts and the corresponding edges.

Figure 17:
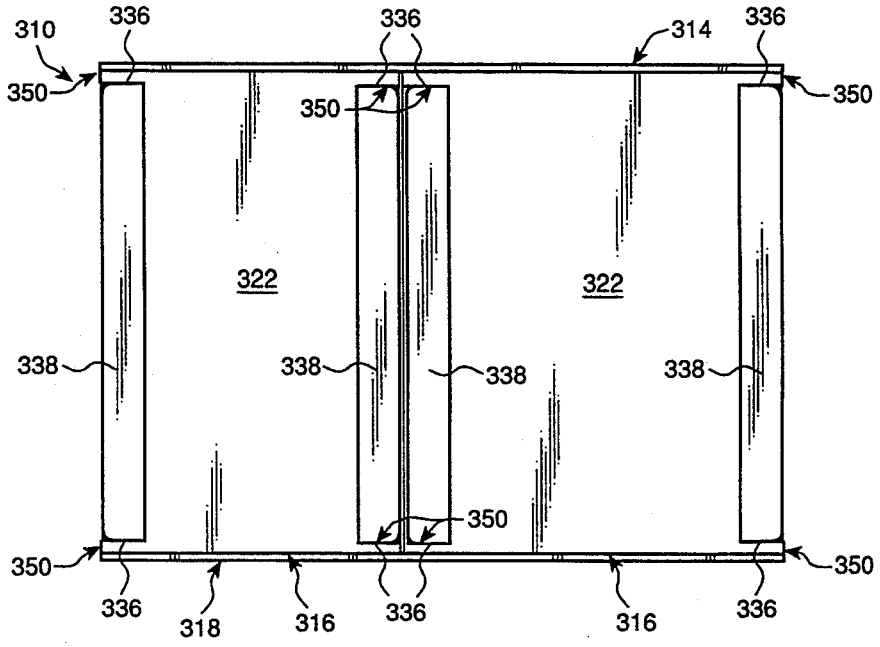
FIG. 17 is a bottom plan view of the package shown in FIG. 16.
Figure 16:
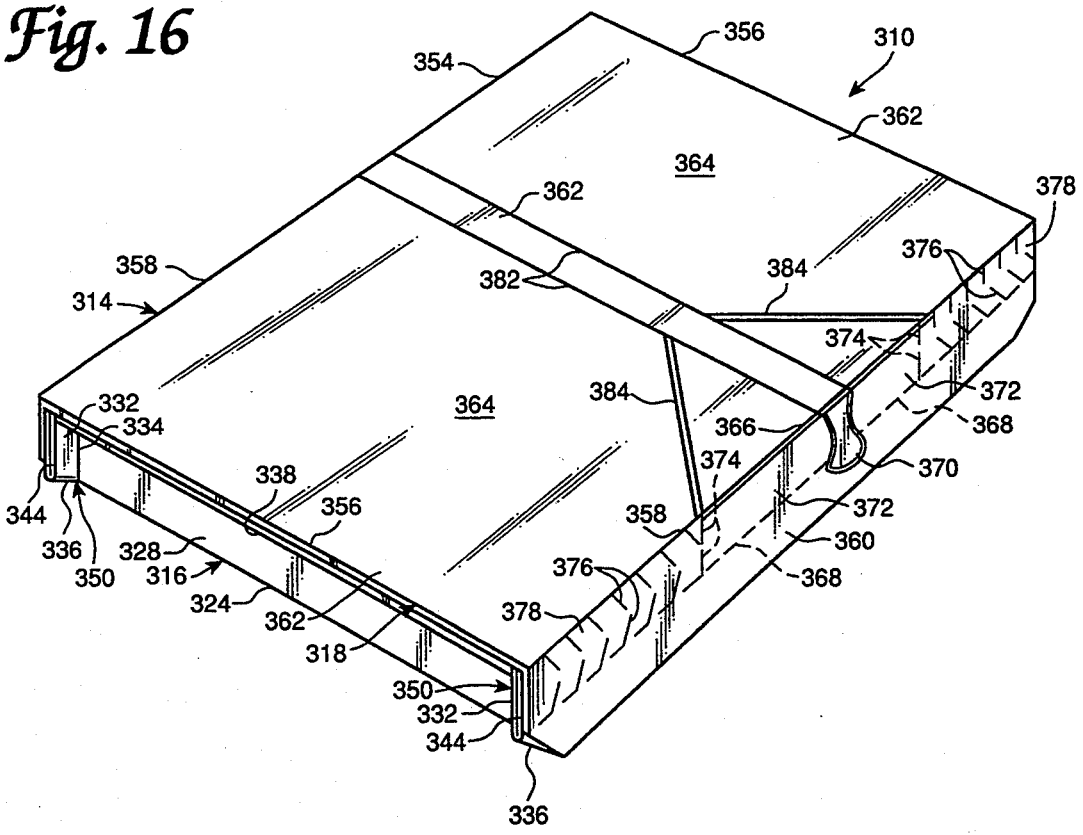
FIG. 16 is a bottom plan view of an alternative embodiment of the carton package according to the principles of the present invention.

Referring now to FIGS. 16 and 17 of the drawings, there is shown therein a plural compartment food package, generally indicated at 310, according to a third embodiment of the present invention. In this embodiment, as in the previous embodiments, all of the integral corner connections are of the first type 49 described above. That is, each corner connection includes a single gusset wall panel folded into surface-to-surface abutting relation with an end portion of an associated side wall panel. The food package 310 consists essentially of a plurality of food portions 312 (see FIG. 23) contained within a carton container assembly, generally indicated at 314, which is made up of a plurality of open top carton tray structures, generally indicated at 316, and a lid structure, generally indicated at 318.

Figure 18:
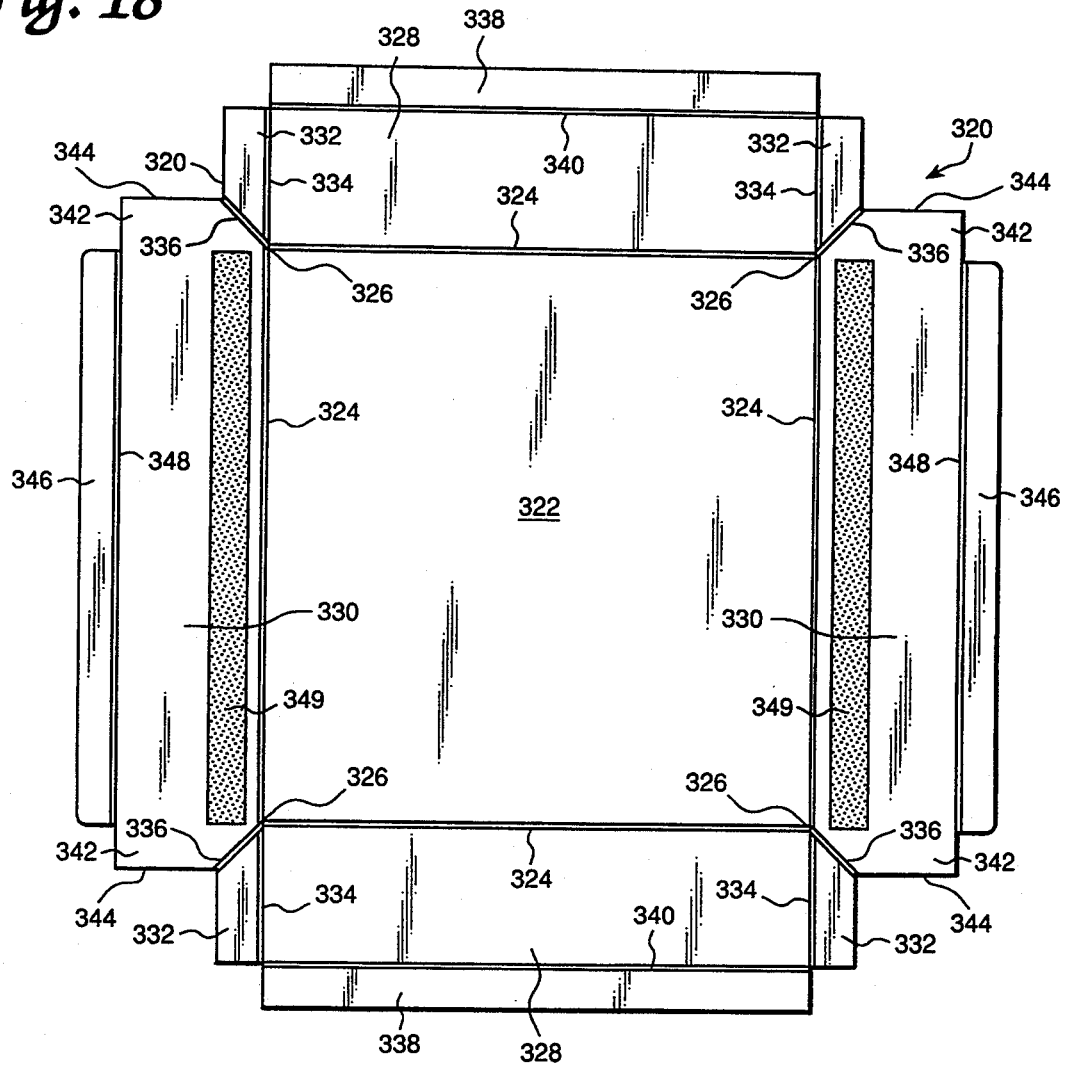
FIG. 18 is a plan view looking at the exterior surface of a tray blank which can be erected to form a tray structure of the package shown in FIG. 16.

Referring now more particularly to FIG. 18 of the drawings, there is shown therein a carton tray blank, generally indicated at 320, which is erectable to form a carton tray structure 316. Preferably, the carton blank 320 is constructed in accordance with the disclosure of the aforesaid '201 patent.

As in the previous embodiments, the blank 320 is formed of any suitable carton material as, for example, paperboard. It will be understood that the carton material may be in the form of a laminate, such as a plastic film (e.g., polypropylene or PET) laminated to paperboard. Preferably, the plastic film is on the interior of the paperboard blank although it may be provided on the exterior as well. The laminate may include in selective portions throughout the paperboard material a microwave susceptor material. The susceptor material may either be microwave-interactive or microwave-shielded material.

As shown, the blank material is suitably cut and/or scored to provide a bottom wall panel 322 defined peripherally by four side fold lines 324 defining four corners 326. The carton tray blank 320 also includes first and second pairs of opposite side wall panels 328 and 330 which are integral with the bottom wall panel 322 along the side fold lines 324. The fold lines 324 may be of any desired construction, an exemplary embodiment being regular bar scores as viewed from the side of the blank forming the exterior of the carton tray when erected. The side shown in FIG. 18 is also the side of the paperboard blank 320 on which the plastic film is adhered when the blank is made of a laminate.

The carton tray blank 320 also includes four gusset wall panels 332, each of which is integral with two adjacent side wall panels 328 and 330 along end fold lines 334 and 336 extending from an associated corner 326 in angularly related relation with respect to one another. As shown, the end fold line 336 of each gusset wall panel 332 is integral with an end of one of the first pair of opposed side wall panels 328 and extends from the associated corner 326 with respect to the associated side fold line 324 at an angle of approximately 90°. The end fold lines 334 may exemplarily be formed as reverse bar scores which are offset with respect to the corner 326 a distance equal to the paperboard thickness. The other end fold line 336 of each gusset wall panel 332 is integral with an end of one of the second pair of opposite side wall panels 330 and extends from the associated corner 326 at an angle of approximately 135° with respect to the associated side fold line 324. The end fold lines 336 may exemplarily be regular bar scores the ends of which are spaced slightly from the ends of the fold lines once folded.

The first pair of side wall panels 328 includes flanges or edge wall panels 338 formed integrally therewith throughout the width thereof along edge fold lines 340. Each of the second pair of opposite side wall panels 330 includes an outer end portion 342 at each end thereof which is defined by the associated fold line 336 and a pair of angularly related peripheral edges 344. Formed integrally on each of the second pair of opposite side wall panels 330 in the central portion thereof between the outermost edges 344 is an edge wall panel 346 which is integral with the associated side wall panel 330 along an edge fold line 348.

As in the other embodiments, a strip of heat activated adhesive emulsion 349 is printed on the exterior surfaces of the side wall panels 330 adjacent the fold lines 324 and allowed to dry to a non tacky condition. The adhesive emulsions utilized are those which have been previously described.

The blank 320 is erectable in accordance with the principles enunciated in the aforesaid '201 patent, into a carton tray structure 316. The method of erection is preferably carried out utilizing a plunger and die type apparatus in which the blank 320 is mounted over the die with the bottom wall panel 322 facing in a direction to receive the plunger which is configured to engage substantially the entire bottom wall panel. As the plunger moves downwardly through the die, the side wall panels 328 and 330 progressively engage the sides of the die and are simultaneously progressively folded about the side fold lines 324 in the same direction. Concurrently with the folding movement of the side wall panels 328 and 330, the gusset wall panels 332 are progressively folded along the angularly related end fold lines 334 and 336 in opposite directions with respect to the associated pair of adjacent side wall panels 328 and 330 so as to bring the gusset wall panels 332 into surface-to-surface abutting relation with the end portions 342 of the side wall panels 330 defined by the end fold lines 336 and edges 344. The gusset wall panels 332 are then adhesively adhered in surface-to-surface abutting relation with the end portions 342 to thereby form a sealed integral corner construction of the first type, generally indicated at 350, between each pair of adjacent side wall panels 328 and 330 extending outwardly from the side wall panels 328.

When a plunger and die apparatus is utilized to carry out the method of erecting of the present invention, preferably the adhesive adhering procedure is performed at the end of the operative stroke of the plunger during which each corner construction 350 is moved past a pair of cooperating pressure rolls to apply an adhering pressure between the interengaged gusset wall panels and end portions.

The adhesive utilized may be of any type including either heat activated or pressure activated adhesives. The adhesive may be separately applied to the appropriate portions of the carton tray blank 320 prior to erection or during erection. Any suitable adhesive may be utilized, it being understood that where the carton material comprises a laminate including a plastic film on the interior surface of the paperboard, portions of the plastic film itself may constitute the adhesive which is activated by heat preferably by directing a stream of hot air locally thereto just prior to the erecting procedure or the operative stroke of the plunger. The latter constitutes a preferred adhesive embodiment.

It can be seen that each sealed integral corner construction 350 of the carton tray 316 thus erected is defined (1) exteriorly by the associated gusset wall panel 332 adhesively adhered in abutting relation to the associated side wall end portion 342 with the associated end fold line 336 extending generally in a plane coincident with an interior surface of the side wall panel 330 from the associated corner 326 and (2) interiorly by the associated end fold line 334 extending from the associated corner 326 along the interior surface of the associated side wall panel 330. It will be understood that the end fold lines need not extend exactly from the corner 326. Indeed, as previously stated, it is desirable that the end fold lines 334 be offset to an extent generally equal to the thickness of the blank material and the end fold lines 336 start in closely spaced relation from the corner 326.

The edge wall panels 338 and 346 may be folded along their respective edge fold lines 340 and 348 either outwardly or inwardly. The construction of the fold lines are chosen to be suitable to the direction of the fold. Preferably, the pair of flanges or edge wall panels 338 are folded outwardly, so that they are coextensive with the corner constructions 350 and the pair of edge wall panels 346 are folded inwardly.

In accordance with the principles of the present invention, a plurality of carton tray structures or parts 316 mounted in cooperating relation with a carton lid structure or part 318 form the carton assembly 314 of the package 310 containing a plurality of food portions 312 within the open top space above the bottom-wall panel 322 defined by the side wall panels 328 and 330 of each tray structure.

Figure 24:
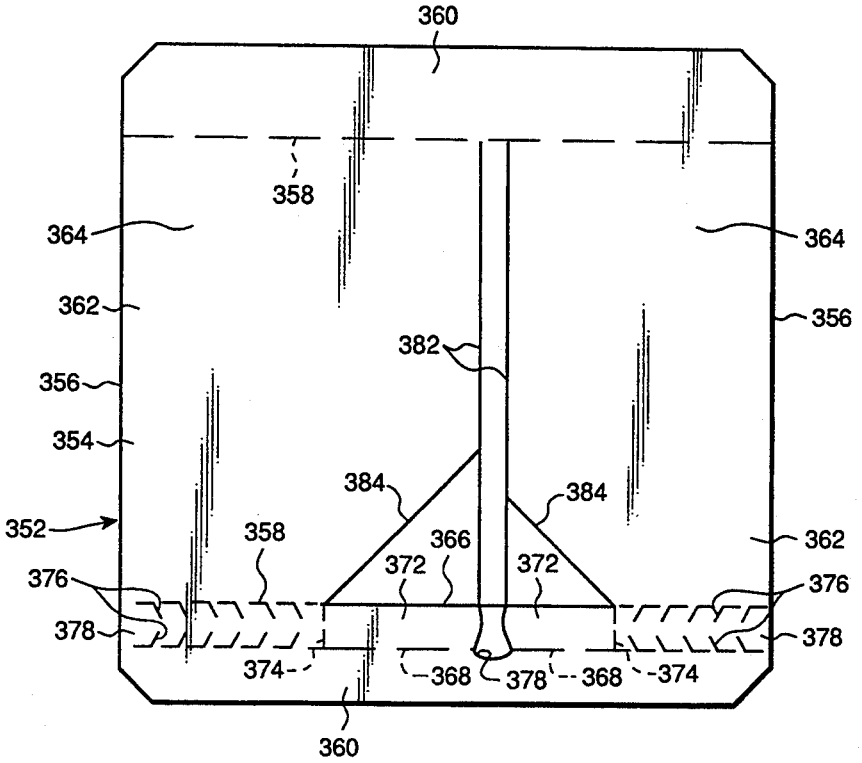
FIG. 24 is a top plan view looking at the exterior surface of a lid blank which can be erected so as to form a lid structure of the package of FIG. 16.
Figure 25:
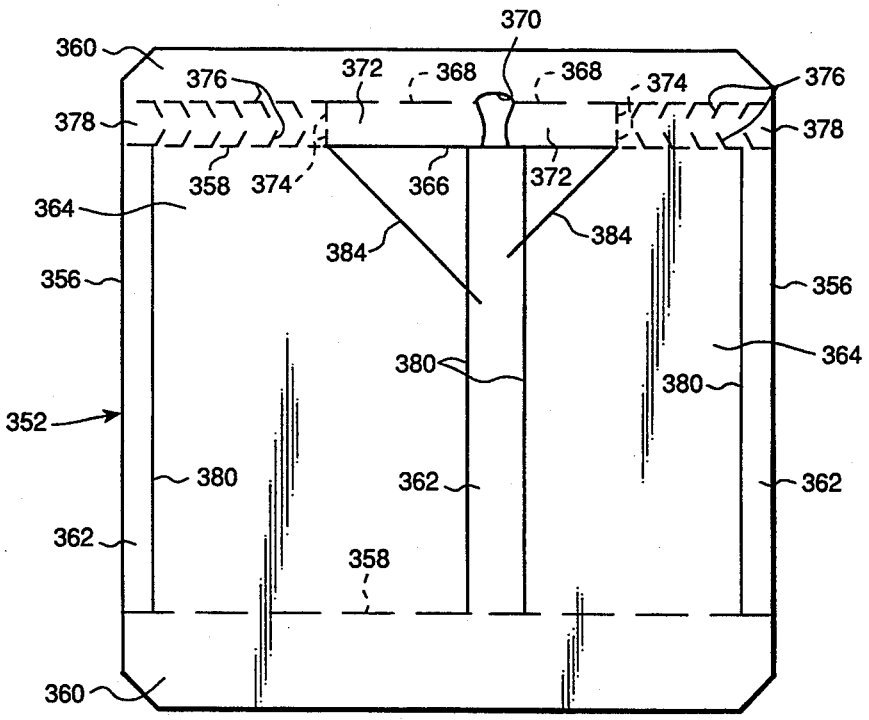
FIG. 25 is a bottom plan view looking at the exterior surface of the lid blank shown in FIG. 24.

FIGS. 24 and 25 illustrate another embodiment of a carton lid blank, generally indicated at 352, which is erectable to form the lid structure 318 of the package 310. The carton lid blank 352 is formed of carton material like that of the tray blank 320. The carton material is cut and scored to define a top wall or lid panel 354 having a rectangular periphery defined on a first pair of opposite sides by cut lid sides or edges 356 and on a second pair of opposite sides by lid fold lines 358 extending between the cut edges 356. Formed integral with the lid panel 354 along the lid fold lines 358 is a pair of lid flap panels 360.

The lid panel 354 includes a planar interior surface shown in FIG. 25 (the plastic film surface when a laminate is used as the carton material) which is divided into four flange-engaging strip-like portions 362, arranged so as to define two top panel portions 364 therein. As shown, two of the four flange-engaging portions 362 are disposed singly along the two cut edges 356 respectively and define face marginal edge portions and two are paired together and extend across the central area of the lid panel 354 between fold lines 358. The position of the paired central flange-engaging portions 362 is determined by the relative shapes of the two tray structures 316 utilized therewith. In the embodiment shown, the trays 316 are of different capacity and size so that the paired central flange-engaging portions 362 are off center. It will be understood that they would be on center where the two trays 316 are of the same size. It will also be understood that the package of the present invention contemplates more than two trays in which case additional paired central flange-engaging portions 362 would be provided.

Figure 23:
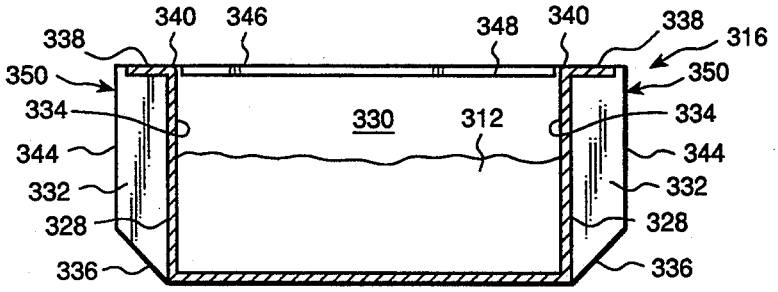
FIG. 23 is a sectional view taken along the lines 23—23 of FIG. 21.

When the package 310 is assembled, it will be understood that, after each tray blank 320 is erected into an open top tray structure 316, each tray is separately filled with a suitable food portion 312, such as shown in FIG. 23. Thereafter, a pair of filled trays 316 are oriented together in side-by-side relation with adjacent outwardly extending flanges 338 in generally closely spaced or abutting relation. Thereafter, the lid structure 318 is mounted over the paired trays 316 so that the downwardly facing interior surfaces of the flange-engaging portions 362 engage the upwardly facing surfaces of the flanges 338.

Where a plastic film laminate is used as the carton material, the interengaging surfaces of the flanges 338 and flange-engaging portions 362 will be plastic film surfaces which serve as adhesives when heated, as by a blast of hot air, to adhere the lid structure 318 to both of the tray structures 316. Thereafter, lid flap panels 360 are folded downwardly along lid fold lines 358 so as to bring the interior surfaces of the top flaps 360 into abutting relation with the exterior surfaces of the side wall panels 330 of the trays 316. Again, a blast of hot air serves to activate the printed adhesive 349 on the exterior surface of the side wall panels 330 and the plastic layer on the interior surface of the lid flap panels 360 so that sealed adherence is obtained on contact.

As assembled, it will be noted that the lid panel portions 364 serve to close the open top of the two trays 316 and enclose the food portions 312 separately in each tray 316. The adhesively adhered and interengaged relation between the flange-engaging portions 362 and lower portions of the lid flap panels 360 with the portions of the trays represented by the flanges 338 and lower portions of side panels 330 retain the assembly in a unitary package suitable for transportation and handling.

In accordance with the principles of the present invention, the lid structure 318 is provided with means in the form of cuts for facilitating the manual lifting of at least a portion of each lid panel portion 364 into opening relation to each tray 316. Preferably, the cuts are made such that an initial relatively small vent opening can be made prior to inserting the package into an oven to heat the contents 312. In this regard, the contents 312 may initially be dry and require the addition of water before heating or the contents may contain liquid so that there is no need to add additional liquid before heating. After the contents have been heated with a smaller vent opening, the preferred arrangement of cuts provides for removing an additional portion of each lid panel portion so as to provide substantially full access for eating the heated contents. It will be noted that the single outside flanges 338 of the trays 316 and the engaged flange-engaging portions 362 of the lid structure 318 provide convenient opposed handles for carrying the package 310 to and from the oven.

FIGS. 24 and 25 illustrate one embodiment of the preferred cuts provided to facilitate the manual opening of the package 310. In the embodiment shown, one of the top flaps 360 has its fold line 358 configured so that a central portion extending into each top panel portion 364 is a conventional bar score 366. Formed in the central portion of the one lid flap panel 360 in parallel relation to the bar score 366 is a broken line of perforate cuts 368. A central section of the one lid flap panel 360 aligned with the paired central flange-engaging portions 362 between the perforate cuts 368 and the bar score 366 is cut out as indicated at 370, so as to divide the section of the one lid flap panel 360 between the perforated cuts 368 and the bar score 366 into two lifting tabs 372 defined at one end by the cut out 370 and at an opposite end by a transversely extending broken line of perforate cuts 374.

The remainder of the one lid flap panel 360 outwardly of the lifting tabs 372 is provided with a series of perforate angular cuts 376 defining a pair of zip strips 378. It will be noted that aligned portions of the angular cuts define the remainder of the fold line 358 associated with the one lid flap panel 360. The fold line 358 of the other lid flap panel 360 may be of any suitable construction, such as a bar score or the broken line of perforate cuts as shown.

In order to facilitate the lifting of the lid panel portions 364 into opening relation, there is formed in the interior surface of the lid panel 354 a series of parallel partial depth cuts 380. The cuts 380 are disposed in positions to define the inner edges of the single flange-engaging portions 362 and the outer edges of the paired flange-engaging portions 362. As shown, a pair of partial depth cuts 382 are formed in the exterior surface of the top wall panel 354 so as to be disposed parallel to and inwardly of the two interior cut lines 380 associated with the paired central flange-engaging portions 362. Finally, a diagonal fold line 384 extends from each lifting tab end 374 to the associated exterior cut line 382. Fold lines 384 are preferably bar scores.

When it is desired to use the package 310, the user grabs first one end of one of the lifting tabs 372 and pulls upwardly, causing the perforate broken line cuts 362 and 374 to release the lifting tab 372 from the plane of the lid flap panel 360. As the lifting tab is moved upwardly, the side defined by the fold line 366 of the corner triangle defined by the fold line 384 is separated from the lid flap panel 360 so that, by pulling up on the lifting tab, the remaining leg of the triangular corner defined by the partial depth cuts 380 and 382 will effectively delaminate between the parallel cuts allowing the corner portion to be hinged upwardly along the fold line 384. This vents the associated contents in the associated tray structure 316 to the atmosphere. By similarly actuating the other lifting tab 372, the other tray structure is similarly vented.

In this condition, the user then carries the package to the oven with the flanges 338 and the engaged portions 362 of the lid panel 354 serving as convenient handles. When the contents have been sufficiently heated, the user then returns the package to the table. It will be noted that, when each of the lifting tabs 372 have been moved upwardly in the manner previously described, the end of each zip strip 372 is conveniently presented to the user to be grasped and zipped off from the remainder of the lid flap panel 360. When each zip strip 372 has been removed, the entire front edge of each lid panel portion 364 defined by the fold line 358 is now released from the one lid flap panel 360 enabling the user to simply continue lifting on each lifting tab 372 to separate substantially the entire portion of each lid panel portion 364 from the lid panel 354. Here again, it will be noted that the lifting action causes delamination to occur between the cut lines 380 and cut edges 356 as well as between the cut lines 380 and 382. Where the fold line 358 of the other lid flap panel 360 is provided by a broken line of perforate cuts, each lid panel portion can be removed from the remainder of the package. When the fold line 358 is a bar score, the lid panel portions are simply folded back. It can thus be seen that substantially full access to the heated contents 312 of each of the trays 316 can be readily obtained by the user.

With this construction, the portion of the lid panel 354 between the partial depth cuts 382 and the delaminated portions between the partial depth cuts 382 and 380 serve to retain the two separate trays 316 together. The arrangement is desirable where the plurality of food portions 312 are such that the heating times for both are the same. It is within the contemplation of the present invention to provide a unitary food package which can be separated so that the contents 312 in each tray 316 can be separately handled and heated for different times when desirable.

Figure 26:
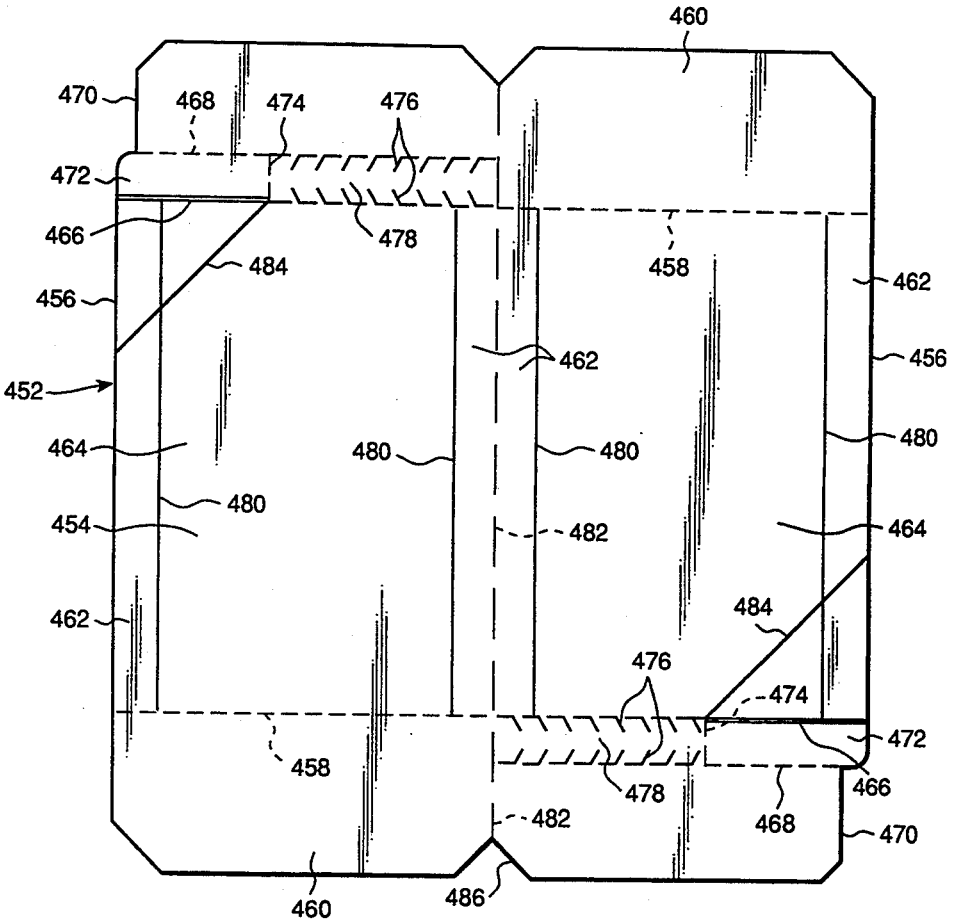
FIG. 26 is a view similar to FIG. 25 of a lid structure of modified form.
Figure 27:
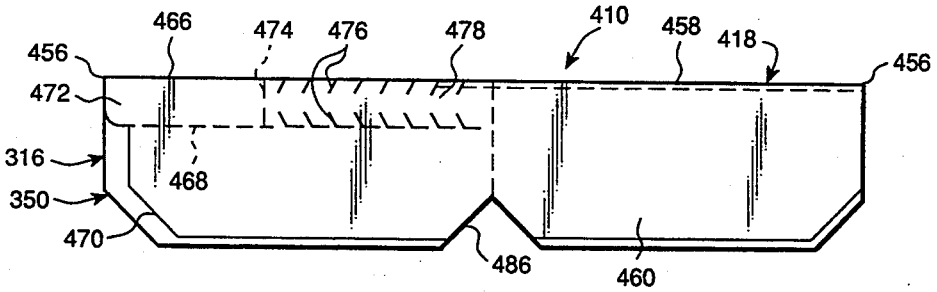
FIG. 27 is a side elevational view of a food package embodying the lid structure shown in FIG. 26.
Figure 28:
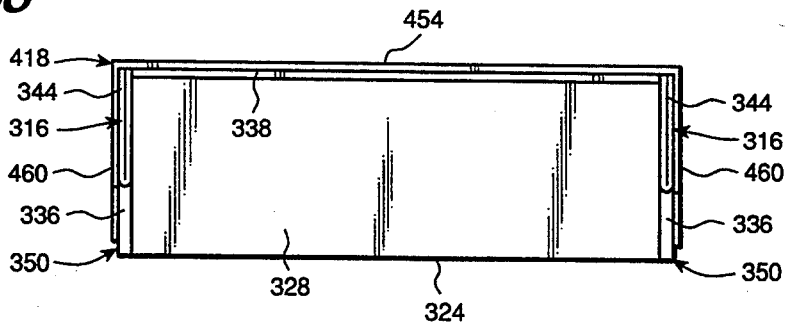
FIG. 28 is an end view of the package shown in FIG. 27.
Figure 30:
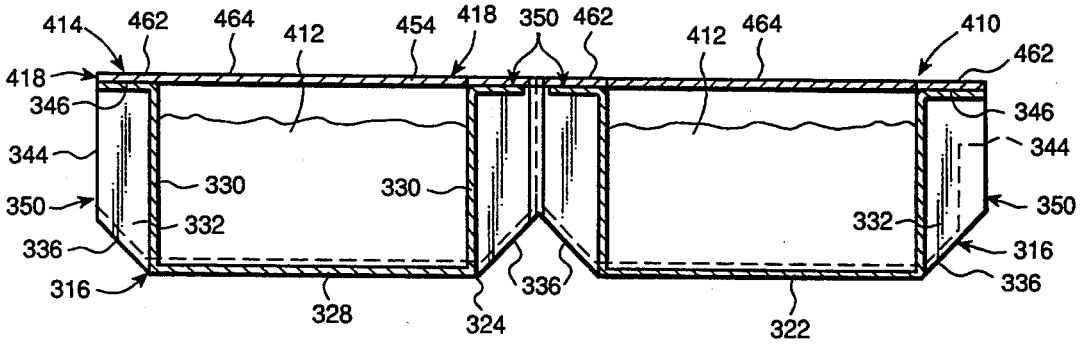
FIG. 30 is a sectional view taken along the lines 30—30 of FIG. 29.
Figure 29:
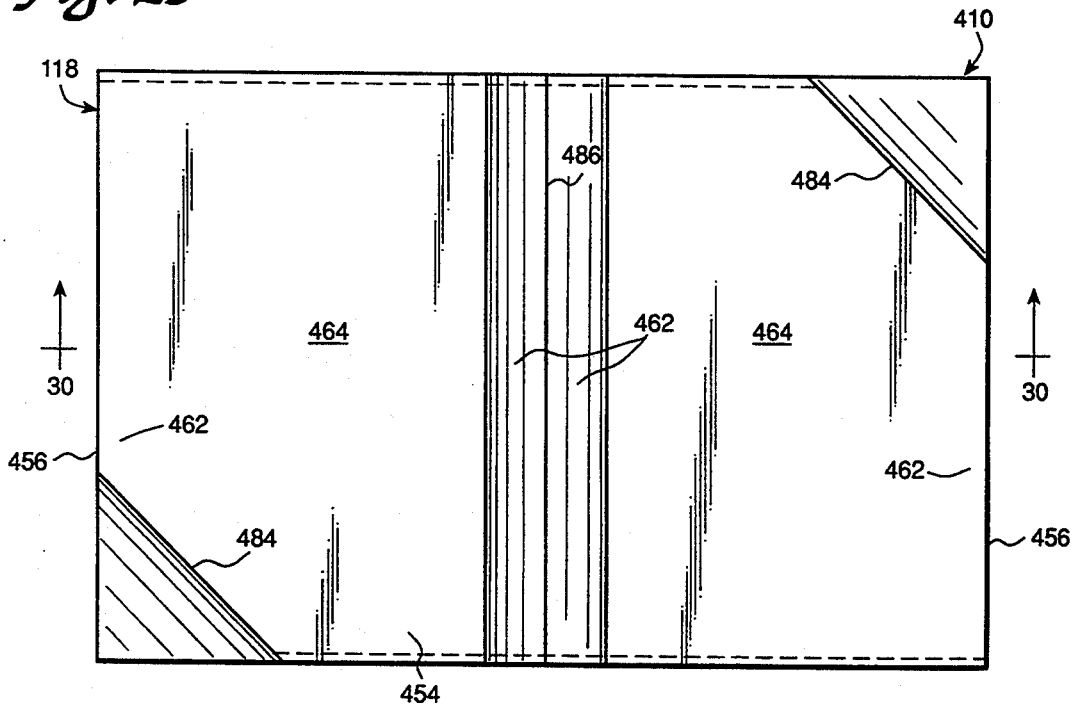
FIG. 29 is a top plan view of the package shown in FIG. 27.

Referring now more particularly to FIGS. 26–30, there is shown therein a separable unitary food package 410 embodying the principles of the present invention. The package 410 includes two tray structures 316 containing food portions 312 and a lid structure 418 which serves to retain the food portions 312 within the trays 316. As best shown in FIG. 26, the lid structure 418 is formed from a carton lid blank 452 formed of carton material like that of the tray blank 320. The carton material is cut and scored to define a lid panel 454 having a rectangular periphery defined on a first pair of opposite sides by cut lid sides or edges 456 and on a second pair of opposite sides by lid fold lines 458 extending between the cut edges 456. Formed integral with the lid panel 354 along the lid fold lines 458 is a pair of lid flap panels 460.

The lid panel 454 includes a planar interior surface shown in FIG. 26 (the plastic film surface when a laminate is used as the carton material) which is divided into four flange-engaging strip-like portions 462, arranged so as to define two lid panel portions 464 therein. As shown, two of the four flange-engaging portions 462 are disposed singly along the two cut edges 456 respectively and define free marginal edge portions and two are paired together and extend across the central area of the top wall panel 454 between fold lines 458. In the embodiment shown, the trays 316 are of the same capacity and size so that the paired central flange-engaging portions 462 are on center.

As before, when the package 410 is assembled, it will be understood that, after each tray blank 320 is erected into an open top tray structure 316, each tray is separately filled with a suitable food portion 312, such as shown in FIG. 23. Thereafter, a pair of filled trays 316 are oriented together in side-by-side relation with adjacent outwardly extending flanges 338 in generally closely spaced or abutting relation. Thereafter, the lid structure 418 is mounted over the paired trays 316 so that the downwardly facing interior surfaces of the flange-engaging portions 462 engage the upwardly facing surfaces of the flanges 338.

Where a plastic film laminate is used as the carton material, the interengaging surfaces of the flanges 338 and flange-engaging portions 462 will be plastic film surfaces which serve as adhesives when heated, as by a blast of hot air, to adhere the lid structure 418 to both of the tray structures 316. Thereafter, top flaps 460 are folded downwardly along lid fold lines 458 so as to bring the interior surfaces of the top flaps 460 into abutting relation with the exterior surfaces of the side walls 330 of the trays 316. Again, a blast of hot air serves to activate the printed adhesive 349 on the exterior surface of the side wall panels 330 and the plastic layer on the interior surface of the lid flap panels 360 so that sealed adherence is obtained on contact.

As assembled, it will be noted that the lid panel portions 364 serve to close the open top of the two trays 16 and enclose the food portions 312 separately in each tray 316. The adhesively adhered and interengaged relation between the flange-engaging portions 462 and lower portions of the lid flap panels 460 with the portions of the trays represented by the flanges 338 and lower portions of side wall panels 330 retain the assembly in a unitary package suitable for transportation and handling.

FIG. 26 illustrates one embodiment of the preferred cuts provided to facilitate the manual opening of the package 410. In the embodiment shown, each of the lid flap panels 460 has its fold line 458 configured so that an end portion extending into a different one of the lid panel portions 364 is a conventional bar score 366. Formed in the end portion of each lid flap panel 460 in parallel relation to the bar score 466 is a broken line of perforate cuts 468. An outer end section of each lid flap panel 460 aligned with the associated single flange-engaging portion 462 beyond the perforate cuts 468 is cut out as indicated at 470, so as to expose a corner section of each lid flap panel 460 between the perforated cuts 468 and the bar score 466. Each corner section forms a part of a lifting tab 472 defined at one end by the exposed corner section and at an opposite end by transversely extending broken line of perforate cuts 374.

The remainder of the associated half of each lid flap panel 460 inwardly of each lifting tab 472 is provided with a series of perforate angular cuts 476 defining a zip strip 378. It will be noted that aligned portions of the angular cuts 476 define a portion of the associated fold line 458. The other half of each fold line 458 may be of any suitable construction, such as a bar score or the broken line of perforate cuts as shown.

In order to facilitate the lifting of the top panel portions 464 into opening relation, there is formed in the interior surface of the lid wall panel 454 a series of partial depth cuts 480. The cut lines 480 are disposed in positions to define the inner edges of the single flange-engaging portions 462 and the outer edges of the paired flange-engaging portions 462. As shown, a central broken line of perforate cuts 382 is formed in the lid wall panel 354 so as to be disposed between the two interior cut lines 480 associated with the paired central flange-engaging portions 462. As before, a diagonal fold line 484 extends from each lifting tab end 474 to the associated exterior cut edge 456. Fold lines 384 are preferably bar scores. Finally, it will be noted that the broken line of perforate cuts 482 formed in the top wall panel 454 extends at both ends into the lid flap panels 460 to a central notch 486 formed in the central outer portion of each lid flap panel 460.

Where the fold line 458 of the other lid flap panel 460 is provided by a broken line of perforate cuts, each lid panel portion can be removed from the remainder of the package 410. When the fold line 458 is a bar score, the lid panel portions are simply folded back. It can thus be seen that substantially full access to the heated contents 312 of each of the trays 316 can be readily obtained by the user.

The package 410 is similar to the package 310 except that the broken line of perforate cut 482 which extends between the two central notches 486 and each top flap 460 enables the user to separate the package into two separable units simply by applying a separating pressure to the notches sufficient to cause the perforate cut to release the lid structure 318 into two separate pieces, each of which is still in closed relation with an associated tray 316. This capability enables the user to heat the contents of each tray for a separate or different time period.

Otherwise, it will be noted that the package 410 is assembled in the same way as the package 310, is of unitary construction for convenient transportation and handling in the same way as the package 310, and is capable of being opened in substantially the same way as the package 310 with respect to each of the trays thereof.

In all of the embodiments of the invention specifically described above and shown in the drawings, it will be noted that the carton assembly 314 provides rigidity to the package 310 or 410. This rigidity is provided by the side-by-side flanges 338 of the trays 316 extending across the central portion of the lid wall panel 354 or 454 between the lid flap panels 360 or 460 and the downward extension of the lid flap panels from the lid wall panel which form exterior sides of the package. The lid flap panels also provide a substantially smooth unitary exterior surface along the package sides for displaying indicia thereon in an uninterrupted fashion.

The differences in the positioning of the cuts which facilitate opening within the lid blank of the two embodiments illustrate variations which are possible. Thus, there is no particular criticality in the location of the cuts insofar as the broad aspects of the present invention is concerned. That is, the lifting tab associated with each tray may be on any one of the four corners of the tray with the zip strip extending alongside the lifting tab. Moreover, it should be understood that, in the broadest aspects of the present invention, other cut arrangements for opening packages of this type can be utilized.

It will also be understood that all of the carton packages thus far described utilize plural tray compartments and separate lid structures of similar construction. It will be understood that a packaging line will include a portion where the filled trays are covered with a separate lid structure. This portion of the line will include a mechanism for feeding separate lid structures from a suitable supply as for example a stack of lid blanks. The line will include a mechanism for positioning the lid structure on the tray compartments so that the interior plastic surfaces flanges of the tray compartments can be sealed to the interior plastic surfaces of the lid panel. This sealing is accomplished by a blast of hot air onto the plastic surfaces which activates the plastic into a sticky adhesive condition. Thereafter, pressure may be applied to the flanges and the free marginal edge portions of the lid structure engaging the same. Such pressure may be applied by cooperating rollers the lower one of which is apertured to accommodate the projecting corner constructions thereunder. Finally, the lid flap panels are bent down and sealed by a blast of hot air on the adhesive and plastic layer enabling contact pressure to effect the seal.

Figure 19:
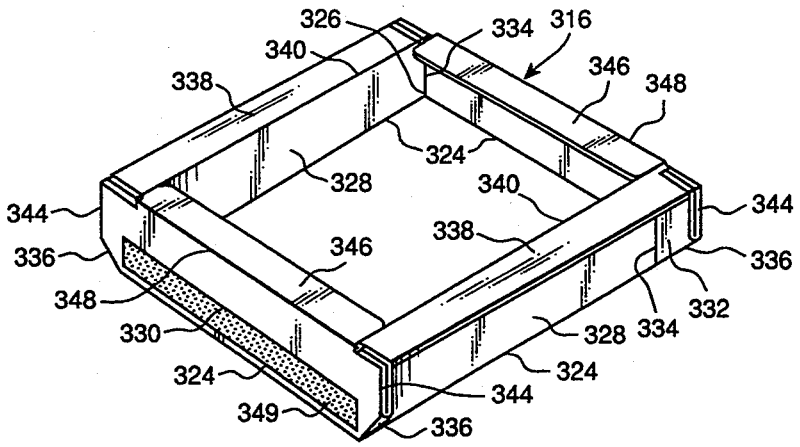
FIG. 19 is a perspective view of the tray erected from the blank shown in FIG. 18.
Figure 20:
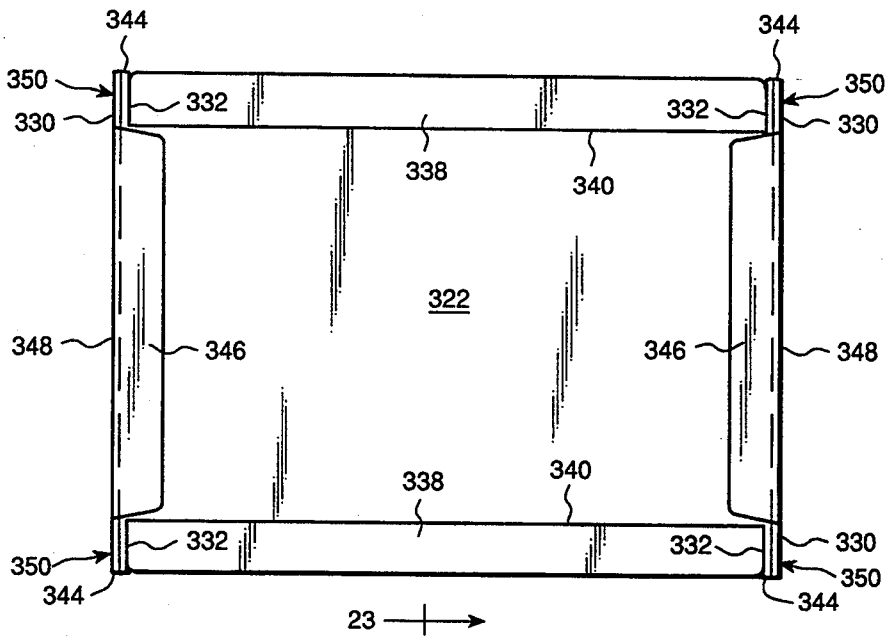
FIG. 20 is a top plan view of the tray shown in FIG. 19.
Figure 21:
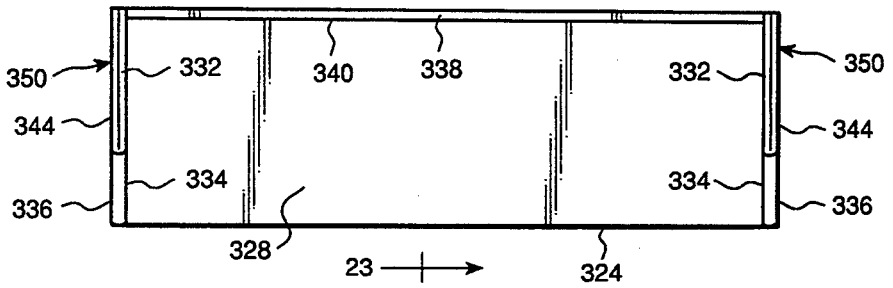
FIG. 21 is a front side view of the tray shown in FIG. 19.
Figure 22:
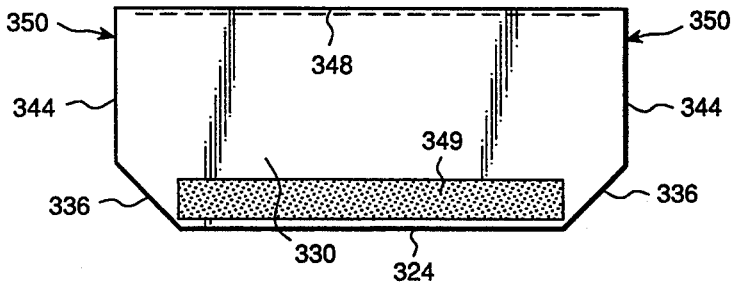
FIG. 22 is an end side view of the tray shown in FIG. 19.

In many packaging situations, it will be desirable to run carton packages having a different plural compartment trays of the type already described. It will also be desirable to run carton packages having only a single compartment. Quite clearly, this will not be possible if the single compartment tray is formed with an integral lid, such as described in the aforesaid '159 patent. The present invention contemplates a carton package 530 formed from a single tray compartment of the type described above formed from the tray blank 320 shown in FIG. 18 and erected into the tray structure 316 shown in FIG. 19.

Figure 31:
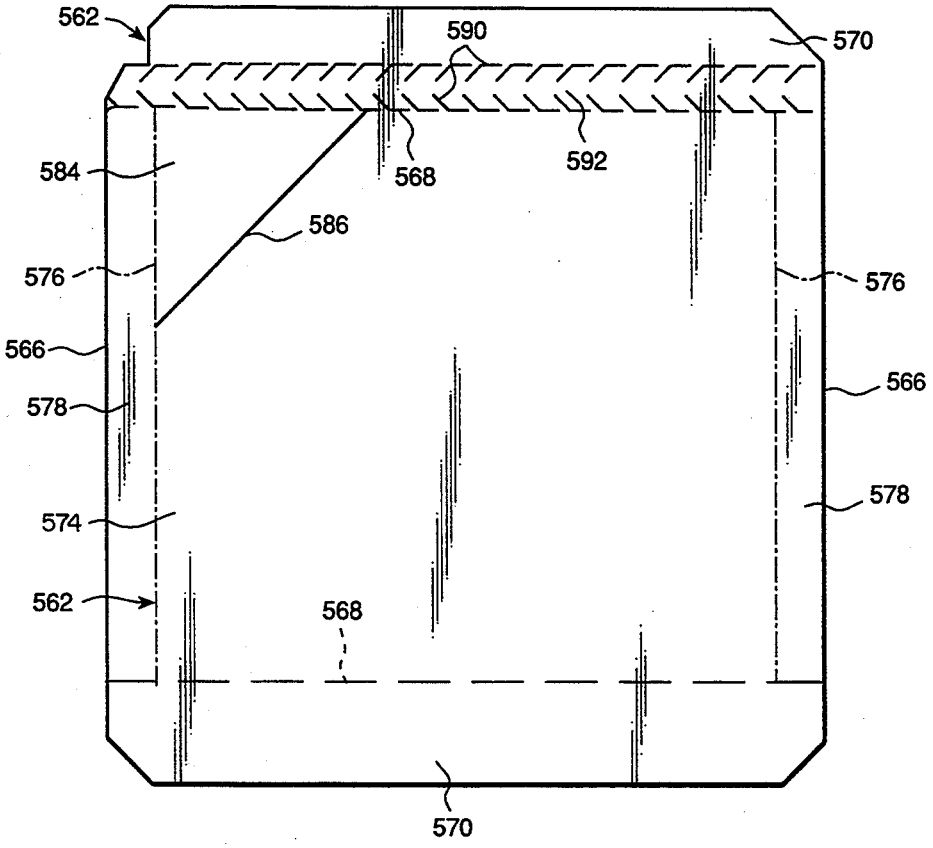
FIG. 31 is a top plan view looking at the exterior surface of a lid part blank used in making a carton package having one tray compartment embodying the principles of the present invention.
Figure 32:
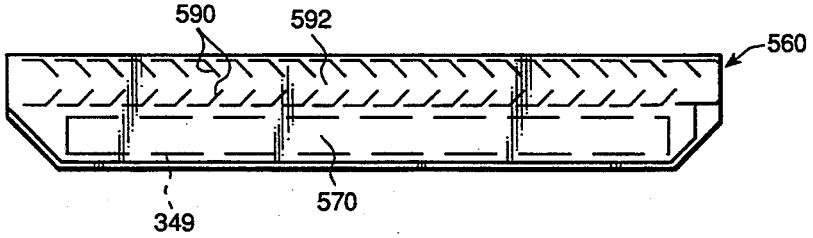
FIG. 32 is a side elevational view of a carton package utilizing the lid part blank shown in FIG. 31 with a single tray compartment blank, such as shown in FIG. 18, erected as shown in FIG. 19.
Figure 33:
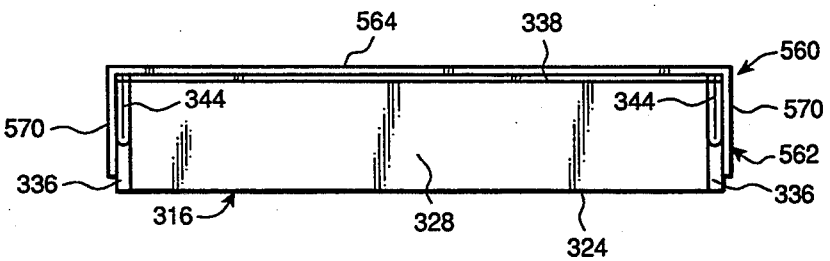
FIG. 33 is an end elevational view of the carton package shown in FIG. 32.

FIG. 31 illustrates a lid structure 562 which is utilized with the tray structure 316 to form a carton package 560 shown in FIGS. 32 and 33.

The lid structure 562 includes a lid wall panel 564 of rectangular configuration defined along opposite ends by free edges 566 and along opposite sides by lid panel fold lines 568. The lid wall panel 564 includes a pair of lid flap panels 570 integral therewith along the lid wall panel fold lines 568. As shown, the lid wall panel 564 includes cuts therein defining an eating access section, generally indicated at 574, which is movable to expose an eating access to the contents of the carton tray 316 when the carton blank 320 is in an erected position. In an exemplary embodiment the cuts in the lid wall panel 564 defining the eating access section 574 include interior partial depth cuts 576 on the interior surface of the carton blank, i.e. the surface opposite that shown in FIG. 31. The interior partial depth cuts 576 are each illustrated in FIG. 31 by a solid line broken with a short dash. In an exemplary embodiment, the interior partial depth cuts 576 are located proximate and generally parallel to the free edges 566 so as to define flange engaging portions in the form of elongated free marginal edge portions 578. The cuts defining the eating access section 574 also include and exterior partial depth perforated cuts forming an intermediate portion of one of the lid wall panel fold lines 568 extending between the cuts 576. In this exemplary embodiment, the end portions of the one lid wall panel fold line 568 are regular barscored. It is to be understood that the cuts defining the eating access section can be of any configuration sufficient to allow a portion of the lid wall panel 564 to be moved to provide eating access to the edible contents therein.

Referring again to FIG. 31, the lid wall panel 564 includes a venting access section, generally indicated at 584, providing a venting access to the interior of the carton package 560 when the carton blank 320 is moved into an erect position. In an exemplary embodiment, the venting access section 584 is formed in a corner portion of the lid wall panel 564 defined by a regular barscore 586 in the lid wall panel 564 between the adjacent lid flap panel fold line 568 and the interior partial depth cut 576 proximate to the adjacent free edge 566. The regular barscore enables the venting access section 584 of the lid wall panel 564 to be folded outward to a venting position thereby providing a venting access to the interior of the carton package 560.

Preferably, as before, the lid wall panel 564 and the other lid flap panel 570 are constructed so as to be simply and conveniently manually disconnectable from the carton tray 316 to an extent sufficient to provide (1) a vent for the consumable contents when heated in an oven and (2) access to the heated contents when removed from the oven. Preferably, the two functions are desirably performed in sequence. However, it will be understood that an extent of disconnection sufficient to provide access to the heated contents will automatically provide sufficient disconnection for the vent. In the broadest aspects of the present invention, the means in the lid for facilitating manual disconnection of a portion of the lid from the carton tray can be a single means. It is preferred, however, to provide separate means which are capable of operation in sequence to provide first a vent then access. Nevertheless, in its broadest aspects, the present invention contemplates elimination of facilitating means in favor of venting and access by means of a tool, such as a sharp knife or the like.

The embodiment shown in FIG. 31 illustrates the preferred arrangement for this embodiment of the present invention. As shown, the other lid flap panel 570 includes a detaching means providing access to the vent access section 584 so that it can be moved to its venting position and for detaching a portion of the lid wall panel 564 corresponding to the associated other lid flap panel fold line 568. As shown, the detaching means includes a series of parallel perforated angular cuts 590 defining a zip strip 592 along a portion of the other lid flap panel 570 adjacent the associated front lid flap panel fold line 568 and extending the length thereof. Indeed, the innermost series of cuts form the majority of the associated fold line 568. It is to be understood that the venting means and the detaching means can be formed in any configuration so as to achieve the above-described objectives.

After the carton blank 320 has been erected to form a carton tray 316 in the manner previously described, the tray 316 is then filled. Upon completion of the filling process, the tray 316 is closed applying the lid structure 562 thereto. As before, this involves removing a lid blank from a supply such as a stack of blanks and positioning the blank over the filled tray 316. In this position, the lid wall panel 564 closes the open top of the tray 316 and has the interior surfaces of the free marginal edge portions thereof in surface-to-surface abutting relation with the interior surfaces of the flanges 338. As previously indicated, these surfaces are seqaled by heating the plastic layers thereon with a blast of hot air and pressurizing them together as by a pair of cooperating rollers the lower one of which includes a cut out to accommodate the outwardly extending corner constructions therebelow.

As before, to further maintain the lid wall panel 564 in its closed position, the lid flap panels 570 are folded down and bonded to the exterior surfaces of the side wall panels 330. As before, in order to achieve a sufficiently strong bonded relation between the side wall panels 330 and the lid flap panels 570, the heat seal coating type adhesive 349 is provided on the exterior surfaces of the side wall panels 330. The heat seal coating adhesive 349 is capable of being printed thereon without having to heat the coating and can be printed on the panels 330 before the carton blank 320 is erected to form the carton package 316. For example, the heat seal coating adhesive 349 can be printed onto the carton material at substantially the same time as the indicia are printed thereon. Alternatively, the heat seal coating adhesive 349 can be printed onto the carton material at substantially the same time as the carton material is cut and scored to form the carton blank 320. After being printed on the carton material, the heat seal coating adhesive 349 is capable of drying in a non-tacky state, thus enabling the carton blank 320 with the heat seal coating adhesive 349 printed thereon to be easily handled and transported. The rate in which the heat seal coating is dried can be increased by heating the coating after it has been printed to more quickly evaporate liquids therefrom.

As before, to activate the heat seal coating adhesive 349 heat, a stream of hot air or the like, is applied locally to the heat seal coating adhesive 349 and the associated plastic layer on the lid flap panels so that, upon activation, the heat seal coating adhesive 349 and plastic layer becomes tacky. After activating, the lid flap panels 570 and the side wall panels 330 are contacted together. The activated heat seal coating adhesive 349 and activated plastic layer is capable of bonding the lid flap panels 570 and the side wall panels 330 on contact, thereby forming a bonded relation therebetween without requiring a significant period of time for the bond to form. Once the heat seal coating adhesive 349 and the plastic layer have been activated so as to form a bonded relation between the lid flap panels 570 and the side wall panels 330, the activated adhesives are capable of setting such that they will not be reactivated by heating the carton package 560 and consumable contents therein in an oven. Thus, the bonding relation between the lid flap panels 570 and the side wall panels 330 will be maintained even as the heat seal coating adhesive 349 and plastic layer is reheated, for example, in an conventional or microwave oven. When set in a bonding relation, the heat seal coating 349 has an insubstantial thickness so that the side wall panels 330 and the lid flap panels 570 are maintained in a substantially close surface-to-surface relation.

The operation of the venting means and the eating access section is the same as previously described.

Figure 34:
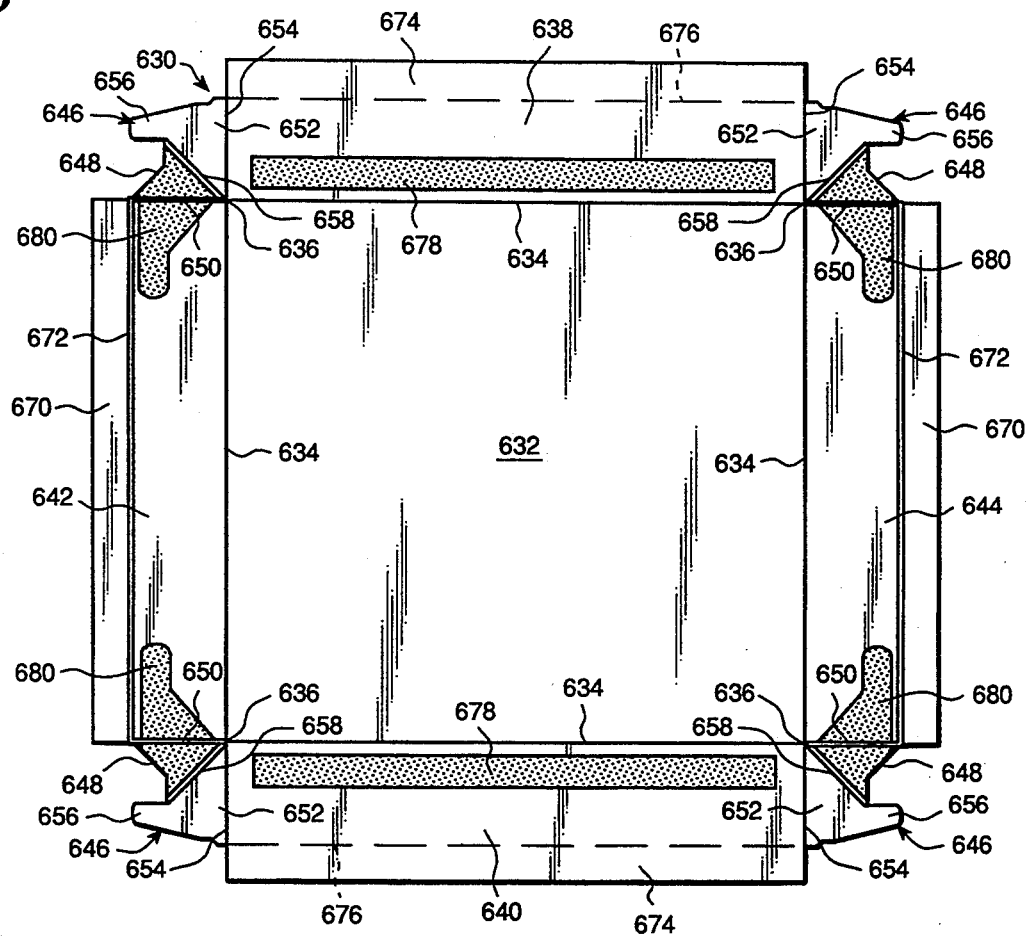
FIG. 34 is a plan view looking at the exterior surface of a tray compartment blank used with the lid part blank of FIG. 31 in making another carton package having one tray compartment embodying the principles of the present invention.
Figure 35:
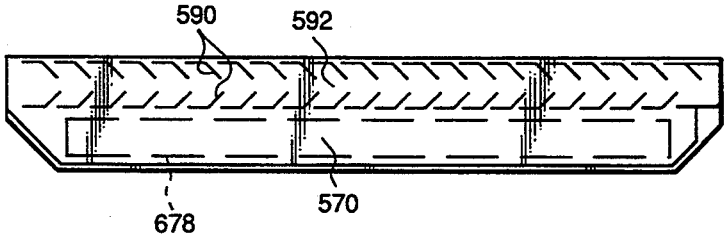
FIG. 35 is a side elevational view of a carton package utilizing the lid part blank shown in FIG. 31 and the tray compartment blank shown in FIG. 34.
Figure 36:
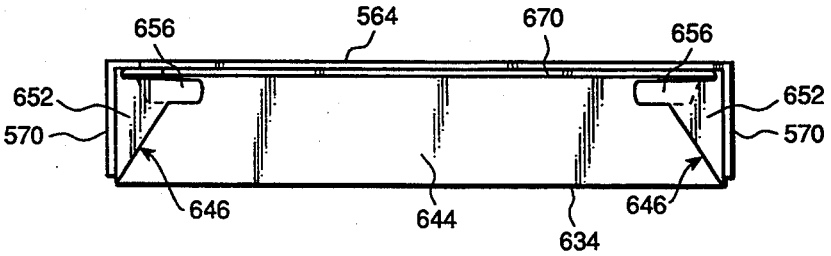
FIG. 36 is an end elevational view of the carton package shown in FIG. 35.

Referring now more particularly to FIG. 34, there is shown therein another carton tray blank 630 which can be used with the lid structure 562 in lieu of the tray 316, according to the principles of the present invention. As shown, the carton blank 630 is cut and scored so as to include a bottom wall panel 632 defined peripherally by four interconnecting side fold lines 634. The side fold lines 634 are interrelated such that there are four different pair of adjacent side fold lines defining four corner points 636. Each adjacent side fold line extends from a corner point 636 thereby defining a corner of the bottom wall panel 632. The carton blank 630 includes four side wall panels 638,640, 642 and 644, which are integral with the bottom wall panel 632 along side fold lines 634 and interrelated such that there are a first, second, third and fourth side wall panels, 638, 640, 642, and 644. As shown, the side fold lines are regular barscored as viewed from the exterior surface of the carton blank enabling the side wall panels 638, 640, 642 and 644 to be folded inwardly with respect to the bottom wall panel 632 so as to form the sides of a carton tray defined by the four side wall panels 638, 640, 642 and 644 and the bottom wall panel 632.

The carton blank 630 includes four integral corner connections, generally indicated at 646, which are foldable to form sealable leak tight corner connections between adjacent side wall panels when the carton blank 630 is in an erected position. As shown, each integral corner connection 646 includes a first gusset wall panel 648 integral with one of the third or fourth side wall panels, 642 and 644, along a first end fold line 650, and a second gusset wall panel 652 integral with one of the first or second side wall panels 638 and 640 along a second end fold line 654. The second gusset wall panel 652 includes an integral protruding portion 656. Each first gusset wall panel 648 is integral with each second gusset wall panel 652 along a central gusset fold line 658. The two end fold lines 650 and 654 and central gusset fold line 658 extend from an associated corner 636 in an angularly related relation with respect to one another. It is to be understood that the two end fold lines 650 and 654 and the central gusset fold line 658 need not extend exactly from the corner 636, but may be offset to an extent generally equal to the thickness of the paperboard material. In an exemplary embodiment of the present invention, the first end fold line 650 forms an angle of approximately 90° with respect to the adjacent side fold line 634, and the second end fold line 654 also forms an angle of approximately 90° with respect to the adjacent side fold line 634. The first end fold lines 650 in an exemplary embodiment are reverse barscored. The second end fold line 654 and the central gusset fold line 658 may exemplary be regular barscored.

The side wall panels 642 and 644 include flanges 670 integral therewith along outer edge fold lines 672. The edge fold lines 672 are generally parallel to the associated side fold lines 634 and in an exemplary embodiment are reverse barscored so that the flanges 670 may be folded outwardly with respect to the bottom wall panel 632. The side wall panels 638 and 640 include flanges or edge wall panels 674 integral therewith along outer edge wall panel fold lines 676. The edge wall panel fold lines 676 are generally parallel with the associated side fold line 634 and, in an exemplary embodiment, perforated so as to enable the edge wall panels 674 to be folded inward with respect to the bottom wall panel 632.

The carton blank 630 includes strips 678 of heat activatible adhesive emulsions of the type previously described printed on an exterior surface of the second side wall panels 638 and 640. As shown, the adhesive 678 is printed on the exterior surface of the side wall panels 638 and 640 in a generally rectangular pattern at a portion thereof proximate to the side fold lines 634.

In the embodiment of present invention shown in FIG. 34, adhesive is also printed on the carton material so as to facilitate forming a bonded relation of the sealed integral corners 646. In an exemplary embodiment, the adhesive is printed on an exterior surface portion of the first gusset wall panels 648 and on the exterior surface of the end portions, as indicated at 680, of the third and fourth side wall panels 642 and 644 corresponding to the position of the first and second gusset wall panels 648 and 652 when the carton blank 630 is in an erect position.

In erecting the carton blank 630, the side wall panels 638, 640, 642 and 644 are folded in a uniform direction relative to the bottom wall panel 632 to form a carton tray. Folding the side wall panels in this manner brings the first end fold lines 650 and the second end fold line 654 together into superposed relation. In this way, each pair of first and second gusset wall panels 648 and 652 are folded together in a surface-to-surface abutting relationship along the associated central gusset fold line 650. Just prior to the movement of the gusset wall panels together, a blast of hot air is directed onto the plastic layer interior surfaces to activate the plastic layer and adhesively seal the gusset wall panels when moved together. Thereafter, the sealed abutting gusset wall panels 648 and 652 are then folded together along the superposed end fold lines so as to bring the two abutted together gusset wall panels 648 and 652 into a surface-to-surface engagement with the adjacent portion of the side wall panels 642 and 644. Again, just prior to this movement, a hot air blast is directed onto adhesive strips 680 on the side wall panels 642, the adhesive on gusset wall panels 648 and the plastic layer on the protruding portions 656. The activation of the adhesives insures that the gusset wall panels will be retained in their folded positions.

The flanges 670 are foldable along their edge wall panel fold lines 672 in an outward position so as to protrude away from the associated side wall panels 644. The edge wall panels 674 are folded along their edge wall panel fold lines 676 in an inward direction.

As before, the erected tray is then filled and a tray blank 562 is assembled thereto in the same way it was assembled on the filled tray 316. In this regard, it will be noted that the ends of the free marginal edge portions 578 of the lid panel 564 which are adhered to the outwardly extending flanges 670 are integrally connected with end portions of the lid flap panels 570. These end portions provide supports which reinforce the ends of the flange in much the same way as they did in the carton package 560 except that the corners do not aid in the reinforcement as the projections do in the package 560 since, with the double gusset wall panel corners, the corners are positioned against the side wall panels 644.

All United States patent applications and United States patents cited or discussed herein are hereby incorporated by reference into the present specification.

It will be seen that the objectives of this invention have been fully and effectively accomplished. It will be realized that the forgoing preferred specific embodiment has been shown and described for purposes of this invention and is subject to change without departure from such principles. This invention includes all modifications encompassed within the spirit and scope of the following claims.

What is claimed is:

1. A carton package providing at least one compartment suitably closed to contain consumable contents therein for shipping and handling so that the contents can be (1) heated in an oven while retained therein in a vented condition and (2) thereafter consumed while retained therein in an accessed condition, said carton package comprising a plurality of blanks of carton material cut and scored so as to provide one or more tray compartments and a separate lid part for said one or more tray compartments, each of said one or more tray compartments including, a bottom wall panel having a periphery defined by interconnecting side fold lines interrelated so that each adjacent pair of side fold lines extends at an angle with respect to each other from a corner point defining a corner of said bottom wall panel, side wall panels extending integrally from said side fold lines and interrelated so there are a plurality of pairs of adjacent side wall panels, said side wall panels being folded upwardly along said side fold lines and having outer edges defining an open top space for containing a consumable content, and an integral corner connection between each pair of adjacent side wall panels, said integral corner connection being folded and sealed so as to form leak-tight sealed integral corners for said open top space, said lid part including a planar rectangular lid panel defining the top of the package, said lid panel having a pair of opposed end edges defined by a pair of opposed parallel free marginal edge portions extending along the top of a pair of opposed ends of the package and a pair of opposed side edges defined by a pair of opposed parallel lid flap panel fold lines, said lid part also including a pair of lid flap panels integral with said pair of opposed side edges and folded downwardly along said lid flap panel fold lines in generally perpendicular relation to said planar lid panel so as to define substantially the entirety of a pair of opposed sides of the package, said planar rectangular lid panel extending over the open top space provided by said one or more tray compartments with said one or more tray compartments presenting (1) side wall panels disposed along said pair of opposed package ends having integral flanges extending outwardly from the outer edges thereof and constituting end defining side wall panels and (2) side wall panels extending along said pair of opposed package sides constituting side defining side wall panels, the interior surfaces of said flanges and the interior surfaces of said lid panel free marginal edge portions being sealed together in pressurized abutting relation with heat activated adhesive therebetween, the exterior surfaces of said side defining side wall panels and the interior surfaces of said lid flap panels being sealed together in contact abutting relation with heat activated adhesive therebetween, said lid part having cuts therein for facilitating the manual venting and accessing of the tray compartment space provided by said one or more tray compartments.

2. A carton package as defined in claim 1 wherein the heat activated adhesive between the interior surfaces of said flanges and the interior surfaces of said lid panel free marginal edge portions is provided by a layer of plastic material on the entire interior surface of the plurality of blanks of carton material providing said one or more tray compartments and said lid part respectively.

3. A carton package as defined in claim 2, wherein the heat activated adhesive between the exterior surfaces of said side defining side wall panels and the interior surfaces of said lid flap panels is provided by a water soluble heat activatible adhesive emulsion printed and dried to a non-tacky condition on selected areas of the exterior surfaces of said side defining side wall panels and said layer of plastic material on the entire interior surface of the blank of carton material providing said lid part.

4. A carton package as defined in claim 3, wherein the free marginal edge portions of said lid panel include ends having integral connections with end portions of said lid flap panels so that the end portions of said lid flap panels provide exterior supports for rigidifying the outwardly extending sealed together flanges and free marginal edge portions.

5. A carton package as defined in claim 4, wherein said plurality of blanks includes only two blanks one of which provides said separate lid part.

6. A carton package as defined in claim 5, wherein another of said two blanks provides a single tray compartment.

7. A carton package as defined in claim 6, wherein each integral corner connection associated with each end defining side wall panel is provided by a gusset wall panel integral with an end of each end defining side wall panel along a first end fold line, each gusset wall panel being integral with an adjacent end of an adjacent side defining side wall panel along a second end fold line, each of said gusset wall panels being folded in opposite directions along the first and second end fold lines thereof so as to be positioned into abutting relation with an end portion of the associated adjacent side defining side wall panel and sealed in said abutting relation to form a leak-tight sealed integral corner which extends outwardly beneath an end of the flange extending outwardly from the associated end defining side wall panel.

8. A carton package as defined in claim 7, wherein each side defining side wall panel has an inwardly folded flange formed integrally with the outer edge thereof disposed generally in engagement with the interior surface of said lid panel.

9. A carton package as defined in claim 6, wherein each integral corner connection associated with each end defining side wall panel is provided by a first gusset wall panel integral with an end of each end defining side wall panel along a first end fold line, each first gusset wall panel being integral with a second gusset wall panel about a second fold line, each second gusset wall panel being integral with an adjacent end of an adjacent side defining side wall panel along a third end fold line, each first and second gusset wall panels being folded along the mutual second fold line thereof so as to be positioned into abutting relation to one another with said first and third end fold lines together and sealed together in said abutting relation, each sealed together first and second gusset wall panels being folded along the first and third end fold lines into abutting relation to the associated end defining side wall panel and retained in said abutting relation.

10. A carton package as defined in claim 9, wherein each side defining side wall panel has an inwardly folded flange formed integrally with the outer edge thereof disposed generally in engagement with the interior surface of said lid panel.

11. A carton package as defined in claim 5, wherein another of said two blanks provides a pair of tray compartments integrally joined along outer edges thereof having side wall panels with exterior surfaces thereof adhered together in contact abutting relation with heat activated adhesive therebetween.

12. A carton package as defined in claim 11, wherein each integral corner connection associated with each end defining side wall panel is provided by a gusset wall panel integral with an end of each end defining side wall panel along a first end fold line, each gusset wall panel being integral with an adjacent end of an adjacent side defining side wall panel along a second end fold line, each of said gusset wall panels being folded in opposite directions along the first and second end fold lines thereof so as to be positioned into abutting relation with an end portion of the associated adjacent side defining side wall panel and sealed in said abutting relation to form a leak-tight sealed integral corner which extends outwardly beneath an end of the flange extending outwardly from the associated end defining side wall panel.

13. A carton package as defined in claim 12, wherein each side defining side wall panel has an inwardly folded flange formed integrally with the outer edge thereof disposed generally in engagement with the interior surface of said lid panel.

14. A carton package as defined in claim 5, wherein another of said two blanks provides a pair of tray compartments with spaced parallel side wall panels interconnected along the outer edges thereof by an integral bridge wall panel portion having an interior surface adhered to an elongated central portion of the interior surface of said lid panel in contact abutting relation with heat activated adhesive therebetween.

15. A carton package as defined in claim 14, wherein each integral corner connection associated with each end defining side wall panel is provided by a gusset wall panel integral with an end of each end defining side wall panel along a first end fold line, each gusset wall panel being integral with an adjacent end of an adjacent side defining side wall panel along a second end fold line, each of said gusset wall panels being folded in opposite directions along the first and second end fold lines thereof so as to be positioned into abutting relation with an end portion of the associated adjacent side defining side wall panel and sealed in said abutting relation to form a leak-tight sealed integral corner which extends outwardly beneath an end of the flange extending outwardly from the associated end defining side wall panel.

16. A carton package as defined in claim 15, wherein each side defining side wall panel has an inwardly folded flange formed integrally with the outer edge thereof disposed generally in engagement with the interior surface of said lid panel.

17. A carton package as defined in claim 4, wherein said plurality of blanks includes three blanks two of which provide two separate tray compartments, said two tray compartments including two spaced parallel side wall panels having integral flanges on the outer edges thereof extending toward one another, the interior surfaces of said flanges being adhered to elongated central portions of the interior surface of said lid panel in contact abutting relation with heat activated adhesive therebetween.

18. A carton package as defined in claim 17, wherein each integral corner connection associated with each end defining side wall panel is provided by a gusset wall panel integral with an end of each end defining side wall panel along a first end fold line, each gusset wall panel being integral with an adjacent end of an adjacent side defining side wall panel along a second end fold line, each of said gusset wall panels being folded in opposite directions along the first and second end fold lines thereof so as to be positioned into abutting relation with an end portion of the associated adjacent side defining side wall panel and sealed in said abutting relation to form a leak-tight sealed integral corner which extends outwardly beneath an end of the flange extending outwardly from the associated end defining side wall panel.

19. A carton package as defined in claim 18, wherein each side defining side wall panel has an inwardly folded flange formed integrally with the outer edge thereof disposed generally in engagement with the interior surface of said lid panel.

* * * * *